US005729809A

United States Patent [19]

Haneda et al.

[11] Patent Number: 5,729,809

[45] Date of Patent: Mar. 17, 1998

[54] COLOR IMAGE FORMING APPARATUS WITH INTERMEDIATE TRANSFER

[75] Inventors: Satoshi Haneda; Hisayoshi Nagase; Hiroyuki Tokimatsu; Shuta Hamada, all of Hachioji; Toshihide Miura, Koganei, all of Japan

[73] Assignee: Konica Corporation, Tokyo, Japan

[21] Appl. No.: 659,366

[22] Filed: Jun. 6, 1996

[30] Foreign Application Priority Data

Jun. 16, 1995 [JP] Japan ..... 7-150293
Nov. 17, 1995 [JP] Japan ..... 7-299960

[51] Int. Cl.[6] ..... G03G 15/01; G03G 15/00

[52] U.S. Cl. ..... 399/308; 399/231; 399/110

[58] Field of Search ..... 399/308, 231, 399/110, 112; 347/118

[56] References Cited

U.S. PATENT DOCUMENTS

| | | | |
|---|---|---|---|
| 4,521,502 | 6/1985 | Sakai et al. . | |
| 4,611,901 | 9/1986 | Kohyama et al. | 399/231 |
| 5,189,478 | 2/1993 | Hara et al. . | |
| 5,438,398 | 8/1995 | Tanigawa et al. | 399/302 |
| 5,541,722 | 7/1996 | Ikeda et al. | 399/178 |
| 5,570,173 | 10/1996 | Nye et al. | 399/251 |

FOREIGN PATENT DOCUMENTS

| | | |
|---|---|---|
| 0 671 667 A2 | 9/1995 | European Pat. Off. . |
| 0 672 960 A2 | 9/1995 | European Pat. Off. . |
| 8-171251 | 7/1996 | Japan . |

OTHER PUBLICATIONS

Patent Abstracts of Japan, vol. 009, No. 054 & JP 59-191072 (Canon KK) Oct. 30, 1984.
Patent Abstracts of Japan, vol. 018, No. 121 & JP 05-307307 (Ricoh Co. Ltd.) Nov. 19, 1993.
Patent Abstracts of Japan, vol. 018, No. 256 & JP 06-035285 (Fuji Xerox Co. Ltd) Feb. 10, 1994.

*Primary Examiner*—Joan H. Pendegrass
*Attorney, Agent, or Firm*—Frishauf, Holtz, Goodman, Langer & Chick

[57] ABSTRACT

A color image forming apparatus includes a drum type image forming body; four charging devices for charging the image forming body; four exposure devices fixed on the main body for imagewise exposing the charged image and forming body to form a latent image; four developing devices each for developing the latent image to form a different colored toner image. After operations by the charging devices, the exposure devices and the developing devices are repeated to superimpose the different colored toner images on the image forming body, the superimposed colored toner images are transferred by a transfer device including an intermediate transferring member and a transfer member in contact with the intermediate transferring member onto a recording material at one time. Two developing devices are disposed at left and right positions, respectively, with respect to a vertical line passing through a center of the image forming body, and another two developing devices are disposed at upper and lower positions, respectively, with respect to a horizontal line passing through the center of the image forming body.

21 Claims, 19 Drawing Sheets

COLOR IMAGE FORMING APPARATUS WITH INTERMEDIATE TRANSFER

BACKGROUND OF THE INVENTION

The present invention relates to an electrophotographic type color image forming apparatus wherein plural charging means, imagewise exposure means and developing means are located around the circumference of a drum-shaped image forming body.

As a method for forming multi-color images, a color image forming apparatus wherein imagewise exposure and developing of images corresponding to each color are subsequently repeated during one rotation of the image forming body so that the toner images of each color are superposed on aforesaid image forming body for forming color images is known.

However, though the above-mentioned color image forming apparatus enables high-speed image forming as a method for forming multi-color images, there are unavoidable contradictions in that it is necessary to provide plural sets of charging means, plural imagewise exposure means and plural developing means around the circumference of the image forming body. There is also the fear that the optical system conducting imagewise exposure is contaminated by toner scattered from developing devices which comes close to aforesaid optical system and, for avoiding the above-mentioned problems, it is necessary to keep a large clearance between the imagewise exposure means and the developing devices, necessarily enlarging the diameter of the photoreceptor drum and thereby enlarging the overall dimensions of the apparatus.

Since plural developing devices are located around the image forming body and pressed against it, distortion on the image forming body easily occurs due to imbalance among the developing devices and blades of the cleaning devices. Fluctuation occurs in the distance between the tube-shaped image forming body which rotates during driving the image forming apparatus and the exposure optical system or charging devices or stable rotation of the photoreceptor drum cannot be obtained so that, in turn, high-quality images could not be obtained. The present inventors proposed a technology in Japanese Patent Application No. 312072/1994 to improve the above-mentioned shortcomings. Namely, as shown in FIG. 19 of aforesaid prior application, 4 of a yellow (Y), a magenta (M), a cyan (C) and a black (K) developing devices 413 are located symmetrically so that imbalance due to pushing pressure of such developing devices on the image forming body is eliminated and stable rotation of the photoreceptor drum is achieved. However, since the paper feeding unit which starts paper feeding cassette 415 to transfer device 414*a* through timing roller 416 and transfer device 414*a*, discharger 414*b* and conveyance belt 414*e* are necessarily located in the vicinity of photoreceptor drum 410, location of Y and K developing devices 413 provided it in lower portion from the center of photoreceptor drum 410 is quite limited. Therefore, this was said to be insufficient as a technology for overcoming the above-mentioned shortcomings. In addition, due to the limit of the above-mentioned transfer region which is a narrow and curved conveyance system, conveyance of transferred paper becomes problematic, and concurrently with this, paper jamming clearing was difficult.

SUMMARY OF THE INVENTION

A first object is to provide a color image forming apparatus wherein plural developing devices are spaced around the image forming body with well balance so that no fluctuation occurs in the distance between the tube-shaped image forming material, which is rotated during driving of the image forming apparatus and the exposure optical system or charging devices, so that consistently high-quality images can be obtained, and concurrently with this, to provide a color image forming apparatus wherein paper feeding of the recording medium and paper jamming clearance in the conveyance and paper-exiting system are easy.

A second object of the present invention is to provide a color image forming apparatus employing an intermediate transfer material wherein, by utilizing space around the circumference of the image forming body more effectively, the required charging means, developing means and cleaning means are well-balanced and located so that they can be conveniently serviced and maintenance is simplified by unifying collection of waste toner and storing waste toner in a container.

An embodiment for attaining the first object of the present invention is a color image forming apparatus in which a tube-shaped image forming body, 4 sets of charging means and developing means on the exterior-circumference of the image forming body and 4 sets of image imagewise exposure means inside the circumference of aforesaid image forming apparatus are provided, the image forming body is charged by the charging means and, due to repeating toner images on the image forming body, the above-mentioned toner images are superposed on the above-mentioned image forming body for forming images, wherein a recording medium housing means which houses a recording medium and an intermediate transfer means which is brought into contact with the image forming material are provided at the lower portion of the image forming body, 4 sets of the developing means are provided horizontally on the image forming body and are at a horizontally and vertically symmetrical position for pressing the image forming body and, after the toner images formed on the image forming body by means of the developing means are temporarily transferred onto the intermediate transfer means, the toner images are re-transferred onto the recording medium fed from the above-mentioned transferred medium housing means by means of the above-mentioned intermediate transfer means.

Embodiments for attaining the above-mentioned second object are as follow.

The first embodiment is a color image forming apparatus, in which, after charging, imagewise exposure and development are repeated on an image forming body so that toner images are superposed on the above-mentioned image forming body, the above-mentioned toner images are collectively transferred to a recording medium by means of a transfer means constituted by an intermediate transfer member and a transfer member, wherein the above-mentioned image forming body is a drum-shaped image forming body and plural of the imagewise exposure fixed on the apparatus main body are located, two of aforesaid developing means are located at a left and a right positions with respect to a vertical line passing a center of the image forming body, and other two developing means are located at an upper and a lower positions with respect to a horizontal line passing the center of the image forming body and the intermediate transfer member is located on one side of the lower position with respect to the horizontal line and on one side with respect to the vertical line of the image forming body and a cleaning means is located at the lower position with respect to the horizontal line and adjacent to the vertical line of the image forming body.

The second embodiment is a color image forming apparatus, in which, after charging, imagewise exposure and development are repeated on an image forming material so that toner images are superposed on the above-mentioned image forming body, the above-mentioned toner images are collectively transferred to a recording medium by a transfer means constituted of an intermediate transfer member and a transfer member, wherein the above-mentioned image forming body is provided with an exposure means, inside the photoreceptor drum, facing the above-mentioned intermediate transfer member and conducts imagewise exposure on the intermediate transfer member concurrently with transferring of the image.

The third embodiment is a color image forming apparatus, in which, after charging, imagewise exposure and development are repeated on an image forming body so that toner images are superposed on the above-mentioned image forming material, the above-mentioned toner images are collectively transferred to a recording medium by a transfer means constituted of an intermediate transfer member and a transfer member, wherein waste toner collected from the above-mentioned image forming material and the above-mentioned intermediate transfer member is stored in a common waste toner container.

The fourth embodiment is a color image forming apparatus, in which, after charging, imagewise exposure and development are repeated on an image forming body so that toner images are superposed on the above-mentioned image forming body, the above-mentioned toner images are collectively transferred to a recording medium by a transfer means constituted of an intermediate transfer member and a transfer member, wherein the above-mentioned transfer member with the integral fixing device can be withdrawn from the apparatus main body concurrently as a unit.

DETAILED DESCRIPTION OF THE PREFERRED EMBODIMENT

(EXAMPLE 1)

Figure 1:
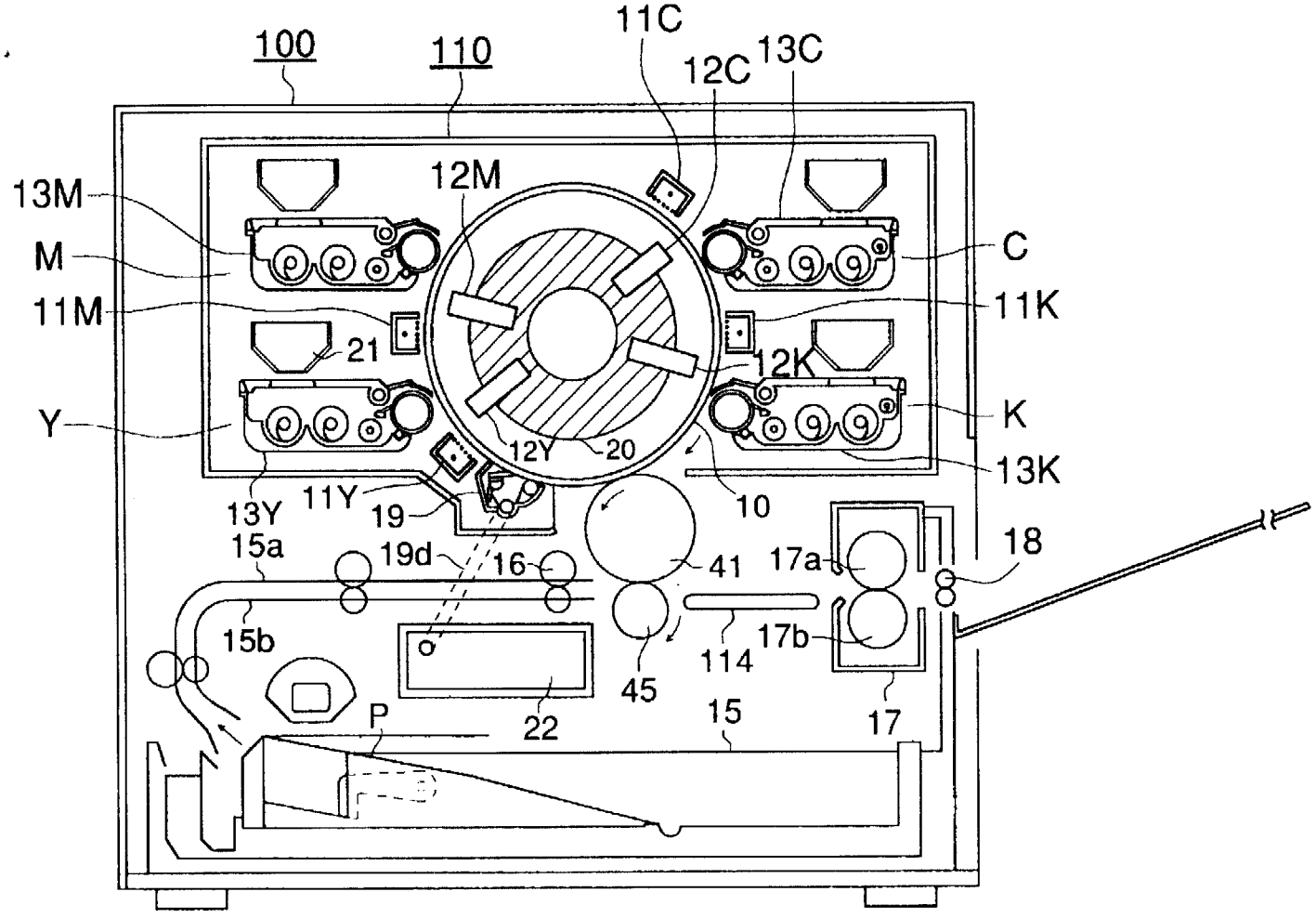
FIG. 1 is a cross-sectional schematic diagram of a color image forming apparatus of Example 1.
Figure 2:
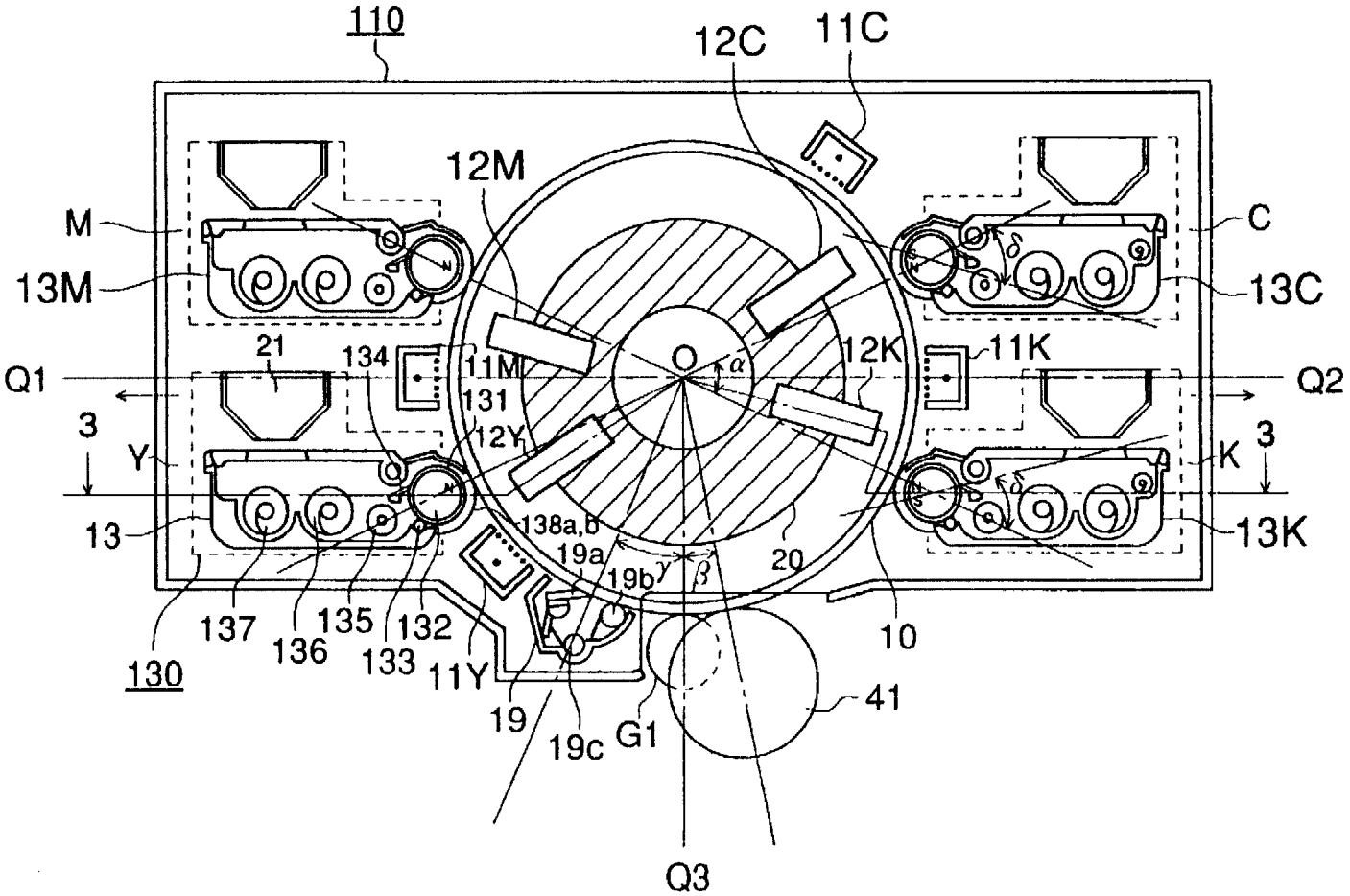
FIG. 2 is a schematic drawing showing preferred locations of developing devices.
Figure 3:
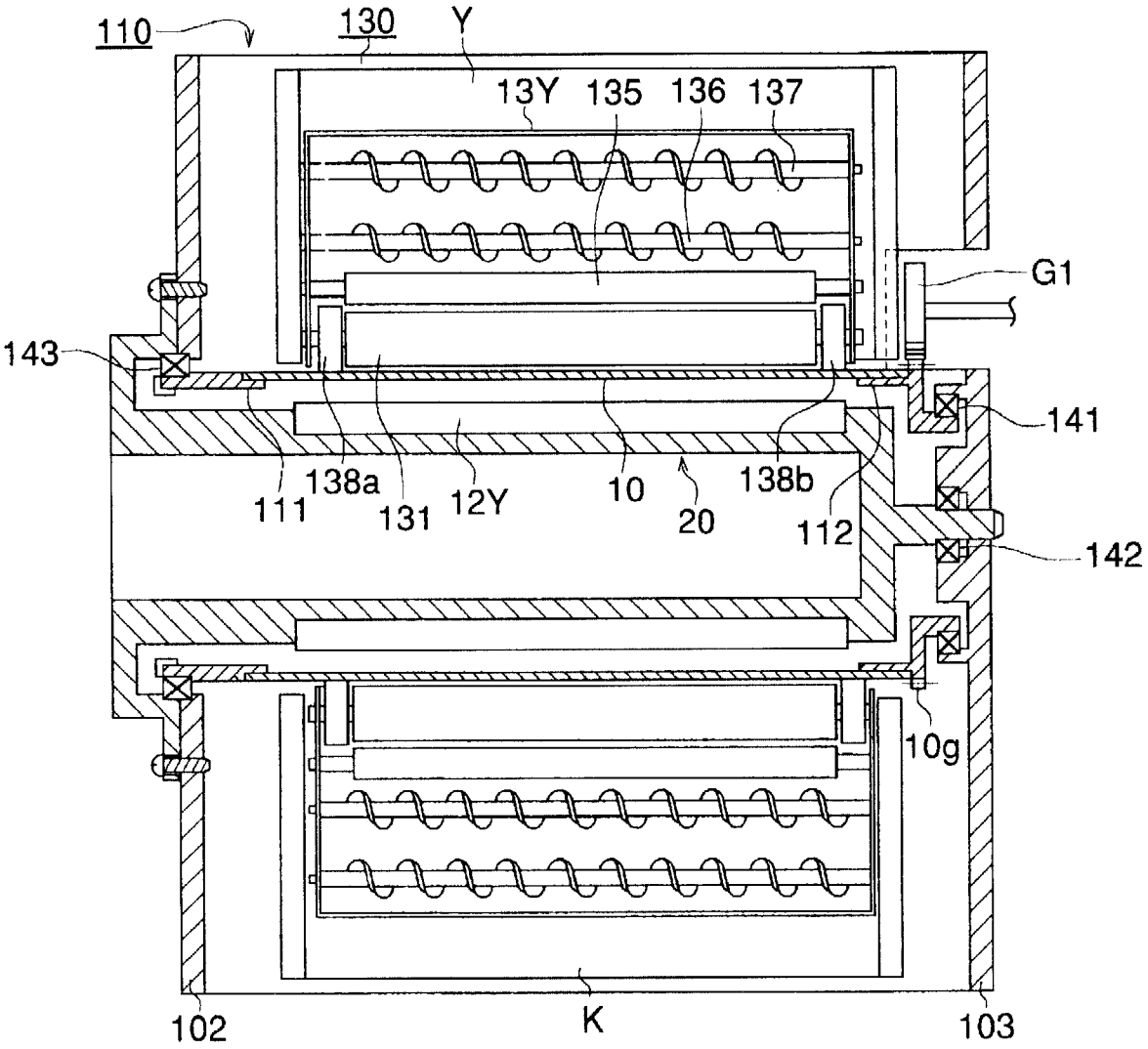
FIG. 3 is a cross-sectional view at 3-O-3 of FIG. 2.
Figure 4:
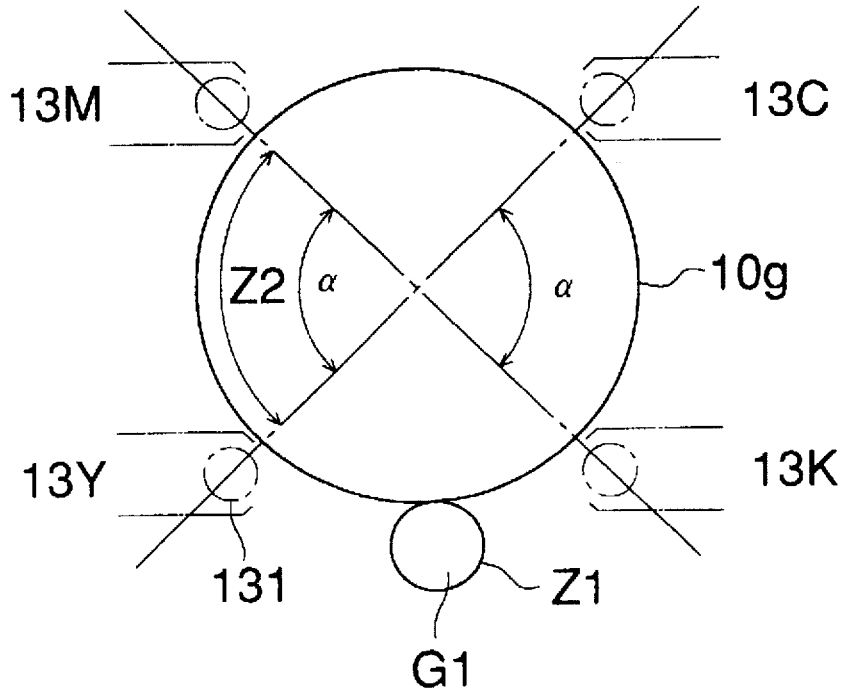
FIG. 4 is a drawing showing a driving gear for the photoreceptor drum.

An image forming process and the mechanism therefore of one example of a color image forming apparatus for attaining the first object will now be explained referring to FIGS. 1–4. FIG. 1 shows a cross sectional schematic diagram of the color image forming apparatus of Example 1. FIG. 2 is a drawing showing preferred locations of various developing devices. FIG. 3 is a cross-section at 3-O-3 of FIG. 2. FIG. 4 shows a driving gear for the photoreceptor drum.

In the color image forming apparatus of Example 1, the substrate of the photoreceptor drum which is an image forming body is formed of a transparent material. A photoreceptor drum wherein, on the outer circumferential surface of the transparent substrate, a photoreceptor layer is provided. Inside the photoreceptor drum, an imagewise exposure means is located. At the exterior of the photoreceptor, various image forming process means including a charger, developing devices, an intermediate transfer roller and cleaning devices are located.

Photoreceptor drum 10 which is an image forming body is provided with a tube substrate formed of a transparent member such as an optical glass or a transparent acrylic resin. On the outer circumference of aforesaid substrate, photoreceptive layers such as a transparent conductive layer, an a-Si layer or an organic photosensitive layer (OPC) are formed. Aforesaid photoreceptor drum 10 rotates clockwise while it is being electrically grounded.

In Example 1, a photoconductive layer on the photoreceptor drum which is an image-formed point of light-exposure beam for imagewise exposure may have any amount of light-exposure having wavelength capable of providing an appropriate contrast to counter the light decay characteristics (light carrier generation) of aforesaid photoconductive layer. Accordingly, the light transmissivity of the transparent substrate of the photoreceptor drum in the present example is not necessarily 100%. A property in which a certain degree of light amount is absorbed when transmitting the light-exposure beam may be provided. As an element for the transparent substrate, soda glass, Pilex glass, silicaborate glass and each light-transmitting resins such acrylic resins, fluorine-containing resin, polyester resin, polycarbonate resin and polyethyleneterephthalate resin which are used for common optical members can be used. In addition, as light-transmitting conductive layer, metal thin layers keeping a light-transmitting property composed of indium-tin oxides (ITO), tin oxide, lead oxide, indium oxide, copper iodide, Au, Ag, Ni and Al are used. As a forming method therefore, a vacuum depositing method, an active reaction depositing method, various spattering methods, various CVD methods, an immersion coating method and a spray coating method are utilized. In addition, as a photoconductive layer, an amorphous-silicone (a-Si) alloy photosensitive layer, an amorphous-selenium alloy photosensitive layer and each organic photosensitive layer (OPC) can be used.

Scorotron chargers 11Y, 11M, 11C and 11K which are charging means, used for image forming process for each color of yellow (Y), magenta (M), cyan (C) and black (K), conduct a charging effect by means of a control grid whose potential is kept to a prescribed level against the above-mentioned organic photosensitive layer on photoreceptor drum 10 and corona discharge using a discharging wire, providing uniform potential to photoreceptor drum 10.

Light-exposure optical systems 12Y, 12M, 12C and 12K which are imagewise exposure means for each color are structured units are composed of light-emitting elements such as bar-shaped FL (fluorescent material lightening) wherein lightening elements arranged in an axial direction of photoreceptor drum 10 was arranged in an array form, EL (electro-luminesance), PL (plasma discharge), LED (light-emitting diode), bar-shaped LISA (photo-electro-magnetic effect light shutter array), PLZT (transmissive piezoelectric element shutter array) and LCS (liquid crystal shutter) and a Selfoc lens as an equivalent-magnification image-forming element. Aforesaid light-exposure optical systems 12Y, 12M, 12C and 12K are mounted on a supporting member 20 provided on photoreceptor drum 10 which holds aforesaid supporting member 20. Image signals for each color read by the image reading apparatus provided separately are subsequently taken up, and then, inputted in light-exposure optical system 12 (Y, M, C and K) as electrical signals. The emitting wavelength of light-emitting elements used in the present example is in the range of 600–900 nm.

Developing devices 13Y, 13M, 13C and 13K which are a developing means for each color, which employ a non-contact development method, respectively use a yellow (Y), magenta cyan (C) and black (K) one-component or two-component developer keep a prescribed clearance from the circumference of photoreceptor drum 10, and are provided with respective developing sleeves 131 which rotate in the same direction as that of the drum.

The above-mentioned developing devices 13 (Y, M, C and K) for each color reverse-develop the static latent images non-contactly formed due to charging by the above-mentioned scorotron charger 11 (Y, M, C and K) and imagewise exposure by light-exposure optical system 12 (Y, M, C and K) by impressing a development bias voltage.

From the original, images are read by an imaging device or edited by a computer in an image reading apparatus provided separately. Aforesaid images are temporarily stored and housed in a memory as image signals for each color.

When starting image recording, rotation of the photoreceptor driving motor causes photoreceptor drum 10 to rotate clockwise. Concurrently with this, electrons are attracted onto photoreceptor drum 10 due to the charging effect of the scorotron charger 11Y.

After potential is provided on photoreceptor drum 10, light exposure by means of electrical signals corresponding to the first color signals, i.e., yellow image signals, starts, wherein static latent images corresponding to yellow images on the original image are formed on the surface photosensitive layer due to rotation scanning by the drum.

The above-mentioned latent images are subjected to reverse development by yellow developing device 13Y while the developer on the developing sleeve does not contact the drum. Corresponding to the rotation of photoreceptor drum 10, yellow (Y) toner images are formed.

Next, on photoreceptor drum 10, potential is provided on the above-mentioned yellow (Y) toner images due to charging effect of magenta scorotron charger 11M so that light is exposed due to electrical signals corresponding to the second color signals of magenta light-exposure optical system, i.e., magenta image signals, wherein magenta (M) toner images was subsequently superposed and formed on the above-mentioned yellow (Y) toner images due to non-contact reverse development by means of M developing device 13M.

Due to similar processes, cyan (C) toner images corresponding to the third color signals are successively superposed and formed by means of cyan (C) scorotron charger 11C, cyan light-exposure optical system 12C and cyan developing device 13C, and black (K) toner images corresponding to the fourth color signals are successively superposed and formed by means of black (K) scorotron charger 11K, black light-exposure optical system 12K and black developing device 13K. Thus, color toner images are formed on the circumference of photoreceptor drum 10 within its one rotation.

Light-exposure on the organic photosensitive layer on photoreceptor drum 10 by means of the above-mentioned Y, M, C and K light-exposure systems 12 (Y, M, C and K) is conducted through the above-mentioned transparent substrate from inside the drum. Therefore, any image light-exposure corresponding to the second, third and fourth color signals are conducted not influenced by the toner images formed in advance. The same static latent images as the images corresponding to the first color signals can be formed. For stabilizing temperature and prevention of temperature rise due to heating by light-exposure optical systems 12 (Y, M, C and K) inside photoreceptor drum 10, the temperature can be controlled to such an extent that no adverse affect effects the apparatus by using a heater when the temperature is too low and by emitting heat to outside the apparatus through a heat pipe when temperature is too high.

In addition, the replenishing developer for each color is replenished to developing devices 13 (Y, M, C and K) corresponding to each color from each replenishing tank 21. The replenished developers were stirred by means of two stirring rollers 136 and 137. Following this, the stirred developers are supplied to the developing sleeve by means of toner supplying roller 135 and thin layer forming rod 133. At both end of developing sleeve outside the image region, pushing rollers **138*a* and 138*b*** are provided.

Developing sleeve 131 is kept non-contacting photoreceptor drum 10 by pushing rollers **138*a* and 138*b* which are brought into contact with photoreceptor drum 10. When developing by means of developing devices (Y, M, C and K) for each color, DC or DC added by AC development bias is impressed to developing sleeve 131 so that jumping development by the one-component or two-component developer housed in each developing device is conducted. DC bias having the same polarity as the toner is impressed on photoreceptor drum 10 wherein a transparent conductive layer is electrically grounded so that non-contact reverse development wherein toner adheres on the light-exposure portion is conducted. Developer on developing sleeve 131 after development is scraped off by cleaning plate 134**.

Successively, the color toner images formed on the circumference of photoreceptor drum 10 are temporarily transferred onto intermediate transfer roller 41 due to the effects of intermediate transfer roller 41. The color toner images formed on the circumference of intermediate transfer roller 41 are fed to the above of the paper feeding cassette which is a transfer member housing means provided to the lower portion of photoreceptor drum 10 at the transfer unit. After passing through upper and lower guide plates 15*a* and 15*b* in the paper feeding unit located horizontally is fed horizontally to timing roller 16. Due to the driving of timing roller 16, the color toner images are re-transferred onto recording paper P which is a recording medium fed synchronously with the toner images on intermediate transfer roller 41 which rotates counter-clockwise by means of transfer roller 45 as a transfer device.

In addition, transfer roller 45 is synchronized with recording paper P which had been fed to the transfer portion by timing roller 16. Only while recording paper P is transferred for length of the circumferential direction of intermediate transfer roller 41, transfer roller 45 is brought into pressure contact with intermediate transfer roller 41. The control unit and the pressure canceling mechanism for the transfer roller provided in the image forming apparatus (not illustrated) operate in such a manner that transfer roller 45 is separated from intermediate transfer roller 41 when transfer processing is not conducted.

After recording paper P which was subjected to toner image transfer is separated from the circumference of the intermediate transfer roller due to curvature of intermediate transfer roller 41, the recording paper P is horizontally conveyed to fixing device 17 through conveyance belt 114 which is a conveyance means. At fixing device 17, the recording paper P is heated and pressed between heating roller 17*a* and pressure roller 17*b* so that the toner is fused and fixed onto the recording paper P. Following this, it is ejected onto a tray at the side portion of color image forming apparatus 100 through paper ejecting rollers 18, with the toner image surface facing down.

Due to the horizontal structure in which the paper feeding, conveyance and paper ejection path from upper and lower guide plates 15*a* and 15*b* to registration roller intermediate transfer roller 41, transfer roller 45, conveyance belt 114, fixing device 17 and paper-ejecting roller 18 is structured horizontally, the toner images are transferred onto recording paper P favorably, and concurrently with this, jamming of recording paper P is minimized.

The surface of photoreceptor drum 10 from which the recording paper had been separated was swept by cleaning blade 19*a* in cleaning device 19 so that residual toner is removed and photoreceptor drum 10 is cleaned. Aforesaid photoreceptor either continues forming of toner images of the original images or temporarily stops for forming the toner images of new original images. Waste toner swept by cleaning blade 19*a* and cleaning roller 19*b* was ejected to waste toner container 22 through toner conveyance screw 19*c* and toner conveyance pipe 19*d*. After the completion of cleaning, in order to prevent damage to photoreceptor drum 10, cleaning blade 19*a* and cleaning roller 19*b* are separated from photoreceptor drum 10.

The photoreceptor drum 10 houses light-exposure optical systems 12 (Y, M, C and K) inside thereof so that transfer region is improved. As a result, on the relatively downsized circumference, plural of the above-mentioned scorotron chargers 11 (Y, M, C and K), developing devices 13 (Y, M, C and K), the cleaning device 19 and intermediate transfer roller 41 can be located. Due to the use of a downsized drum whose outer diameter is between 66–200 mm, the volume of the apparatus can be more compact.

As described above, by providing intermediate transfer roller 41 below photoreceptor drum 10, below space including the transfer region of the photoreceptor drum can be utilized so that the location region allowance for developing devices 13Y and 13K located lower portion of the 4 developing devices 13 (Y, M, C and K) located around the outer circumference of photoreceptor drum 10 becomes greater. As a result, it is possible to provide developing devices 13Y and 13K lowered against the horizontal line which passes the center of the photoreceptor drum compared to already explained prior disclosure of Japanese Patent Application No. 312072/1994. In addition, the angle described later on the above-mentioned downsized drum can be increased.

In such a manner that, on diagonals formed with angles α which are divided into two equal parts by a horizontal line Q1-O-Q2, the center of developing sleeves 131 are located and pushing rollers 138*a* and 138*b* provided for each developing device are brought into pressing contact with photoreceptor drum 10 with equivalent pushing pressure, and four developing devices 13Y, 13M, 13C and 13K located symmetrically above and below and also symmetrically left and right sides and preferably horizontally with photoreceptor drum 10 as the center. Each of the developing devices 13 (Y, M, C and K) is pressed by a pushing spring which is a pushing member (not illustrated), and pushing rollers 138*a* and 138*b* are brought into pressure contact with photoreceptor drum 10. Angle α formed by upper and lower developing devices 13Y, 13M, 13C and 13K and the center of photoreceptor drum 10 is preferably 40° or more, more preferably 60° or more and also preferably 90° or less. As it becomes smaller than 60°, rotation of the image forming material tends to become less stable. On the contrary, as it becomes larger than 90°, pushing pressure by each developing device is not stable. In addition, setting of cleaning devices and the intermediate transfer drum become difficult.

As described above, as resulting from control of the transfer region and improving the paper feeding, conveyance and paper-ejection systems of the transfer region in the color image forming apparatus, due to well-balanced pushing pressure by plural developing devices located outside the image forming material on the tube-shaped image forming material which rotates during driving of the image forming apparatus, the photoreceptor drum can stably rotate and no fluctuation occurs in the clearance between the tube-shaped image forming body which rotates during driving the image forming apparatus and each developing device, the light-exposure optical system and the charging device. Accordingly, an image forming apparatus wherein high quality images can continually be maintained can be provided and desirable color images by means of superposed toner images which necessitate uniform light exposure for each color could be formed.

In order to keep power balance against photoreceptor drum 10, intermediate transfer roller 41, which is brought into contact with photoreceptor 10, is located by forming angle β from a line O-Q3 which perpendicularly crosses a line Q1-O-Q2 at point O on the right side, and also cleaning device 19 is also located by forming angle γ to the left side wherein cleaning blade 19 which is brought into contact with photoreceptor 10 is provided. In order to prepare a suitable transfer region for the intermediate transfer roller, β is preferably 5° or more and 45° or less. Corresponding to this, the contact position of cleaning blade 19 is also preferably 5° or more and 45° or less. Due to well-balanced pushing pressure of plural developing devices arranged outside against the above-mentioned image forming body, and in addition, due to well-balanced pushing pressure of the blade of the cleaning device and the intermediate transfer roller, stable rotation of photoreceptor drum can be obtained.

As a condition for the relation of magnetic pole angle on the image forming material to be identical between each developing sleeve in order to use the upper and the lower developing devices interchangeably, it is preferable to arrange and fix magnetic poles such as the angle δ between magnetic poles of 60° or 30° provided that α=60° or that the angle between magnetic poles δ of 90°, 45° or 22.5° provided that α=60°.

Photoreceptor drum 10 is mounted on front and rear flanges 111 and 112 and is shaft-supported by bearing 141 which is a bearing member provided on rear side plate 103 of processing unit 110 and bearing 143, which is recessed on front flange 111, which is a bearing member mounted on the front side plate of processing unit 110 so that aforesaid photoreceptor drum 10 is mounted rotatably on processing unit 110. While supporting members 20 on which light-exposure optical system 12 (Y, M, C and K) are respectively mounted are housed in photoreceptor drum 10, aforesaid photoreceptor drum 10 is mounted on bearing 142 provided on rear side plate 103 and also mounted on bearing 143 provided on front side plate 102 and fixed with screws on front side plate 102. Processing unit 110 is structured so that cleaning devices 19, scorotron chargers 11 (Y, M, C and K) for each color, developing devices 13 (Y, M, C and K) for each color and replenishing tanks 21 for developers for each color are mounted around the circumference of photoreceptor drum 10.

By opening the opening and closing lid (not illustrated) provided at the top of color image forming apparatus 100 and by removing processing unit 110 upward from color image forming apparatus 100, process members such as photoreceptor drum 10, light-exposure optical system 12 (Y, M, C and K), cleaning devices 19, scorotron chargers 11 (Y, M, C and K), developing devices (Y, M, C and K) and replenishing tanks 21 are subjected to maintenance and/or replaced.

Figure 15:
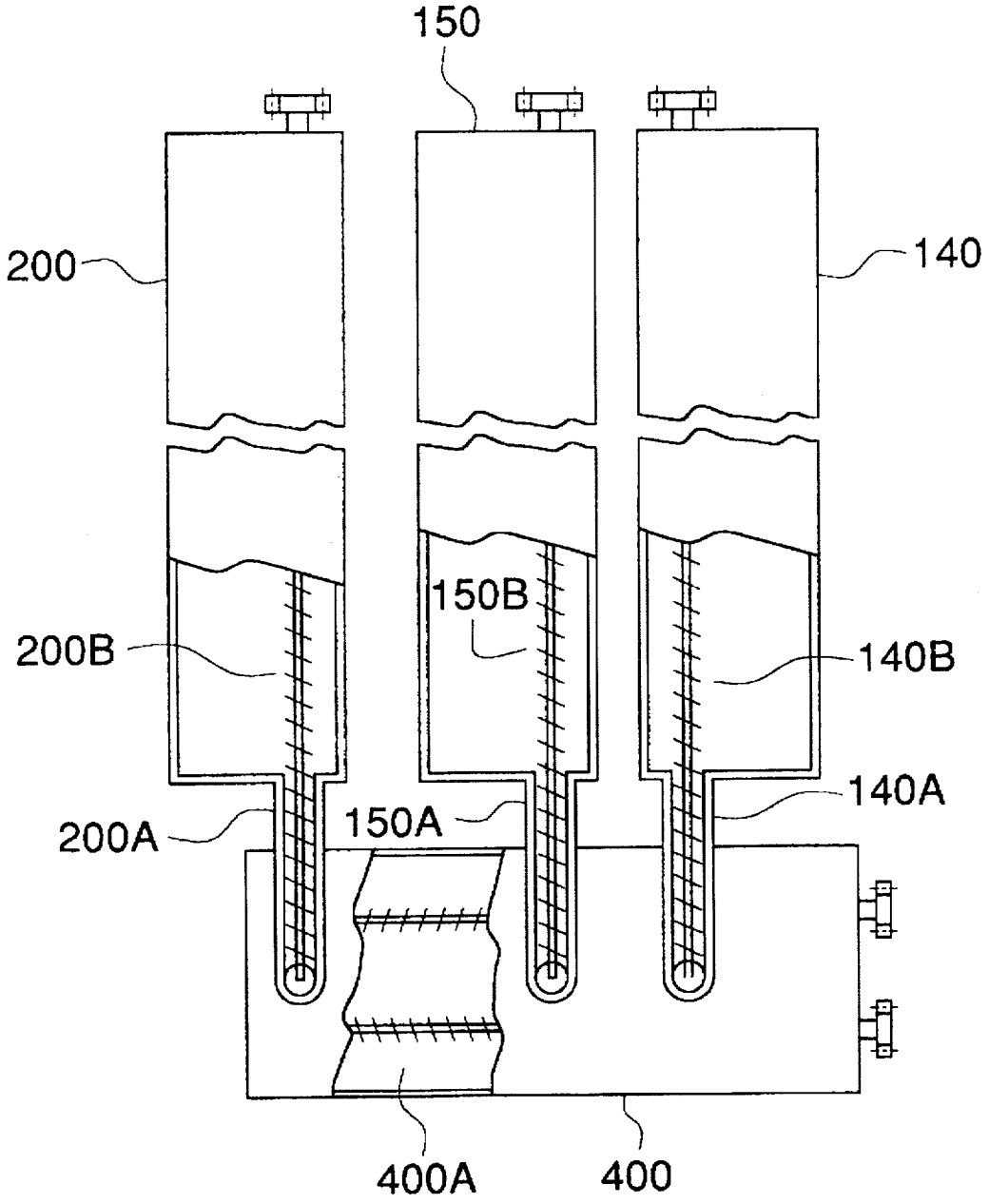
FIG. 15 is a plain view of a waste toner collection path (No. 2).

As showh by a dotted line in FIG. 15, developing devices 13 (Y, M, C and K) corresponding to Y, M, C and K colors and replenishing tanks 21 are respectively formed as integral developing device units 130 so that, when replenishing the developer, opening and closing doors (not illustrated) provided at both sides of process unit 110 are opened so that developing device units 130 are respectively withdrawn left and right and thereby replenishing tanks 21 are replaced.

When processing unit 110 is attached to color image forming apparatus 100, gear **10*g* provided on rear flange 112 of the photoreceptor drum and gear G1 connected to the driving motor (not illustrated) for the photoreceptor drum are combined so that photoreceptor drum 10** becomes rotatable.

In order to guarantee the registration of superposed toner images, it is preferable that the relationship between the teeth number of Z2 of gear **10*g* and teeth number of Z1 of gear G1 each at the circumference of photoreceptor 10**, i.e., corresponding to angle α formed by the above-mentioned developing devices 13Y, 13M, 13C and 13K is Z2=nZ1 (n is a positive integer).

In the above-mentioned examples, when processing unit 110 is detached from and attached to color image forming apparatus 100, unillustrated joints between toner conveyance pipe **19*d* and waste toner container 22** are canceled or combined.

Figure 5:
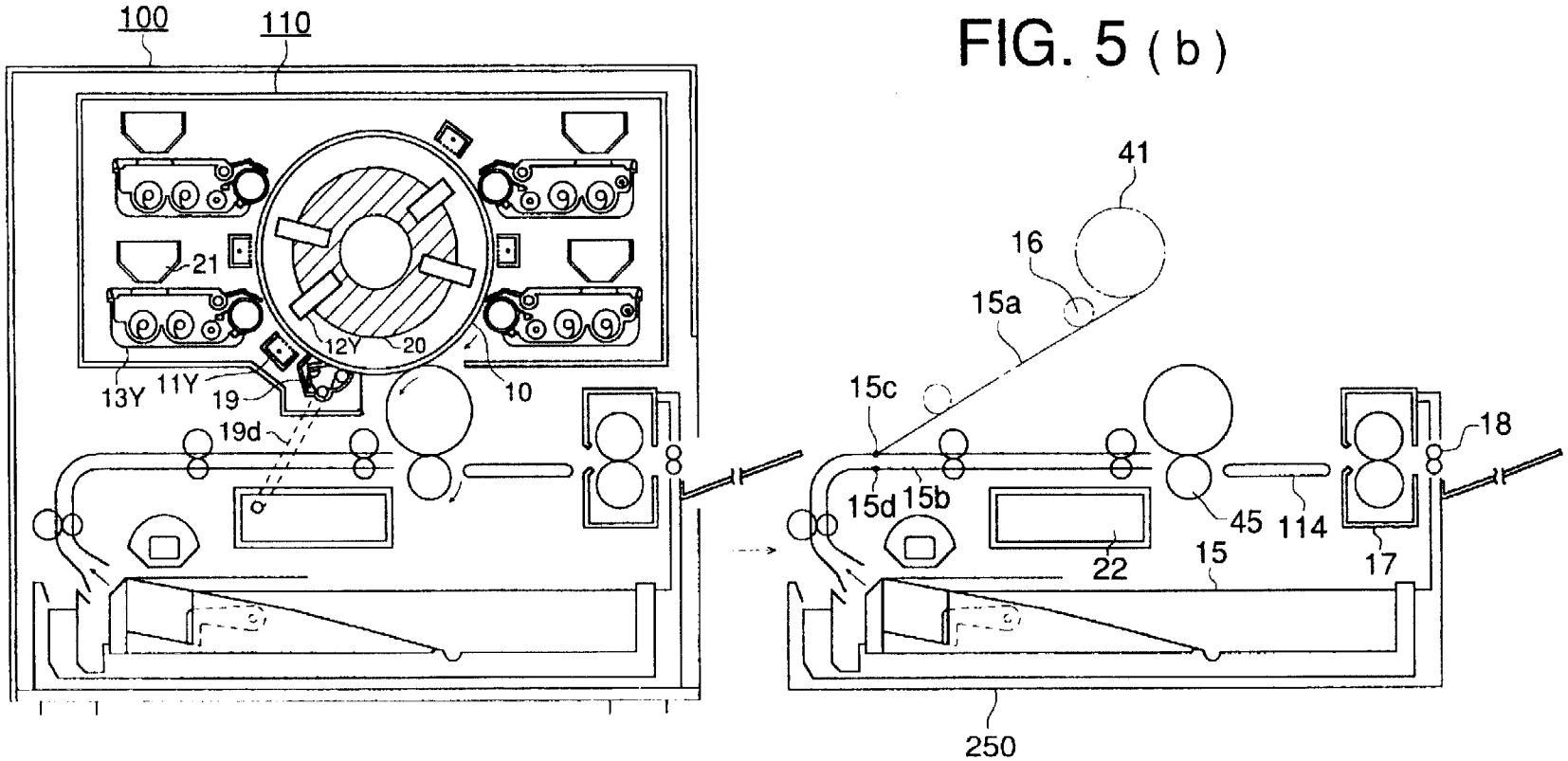
FIGS. 5(*a*) and 5(*b*) are drawings showing paper jamming clearance.
Figure 6:
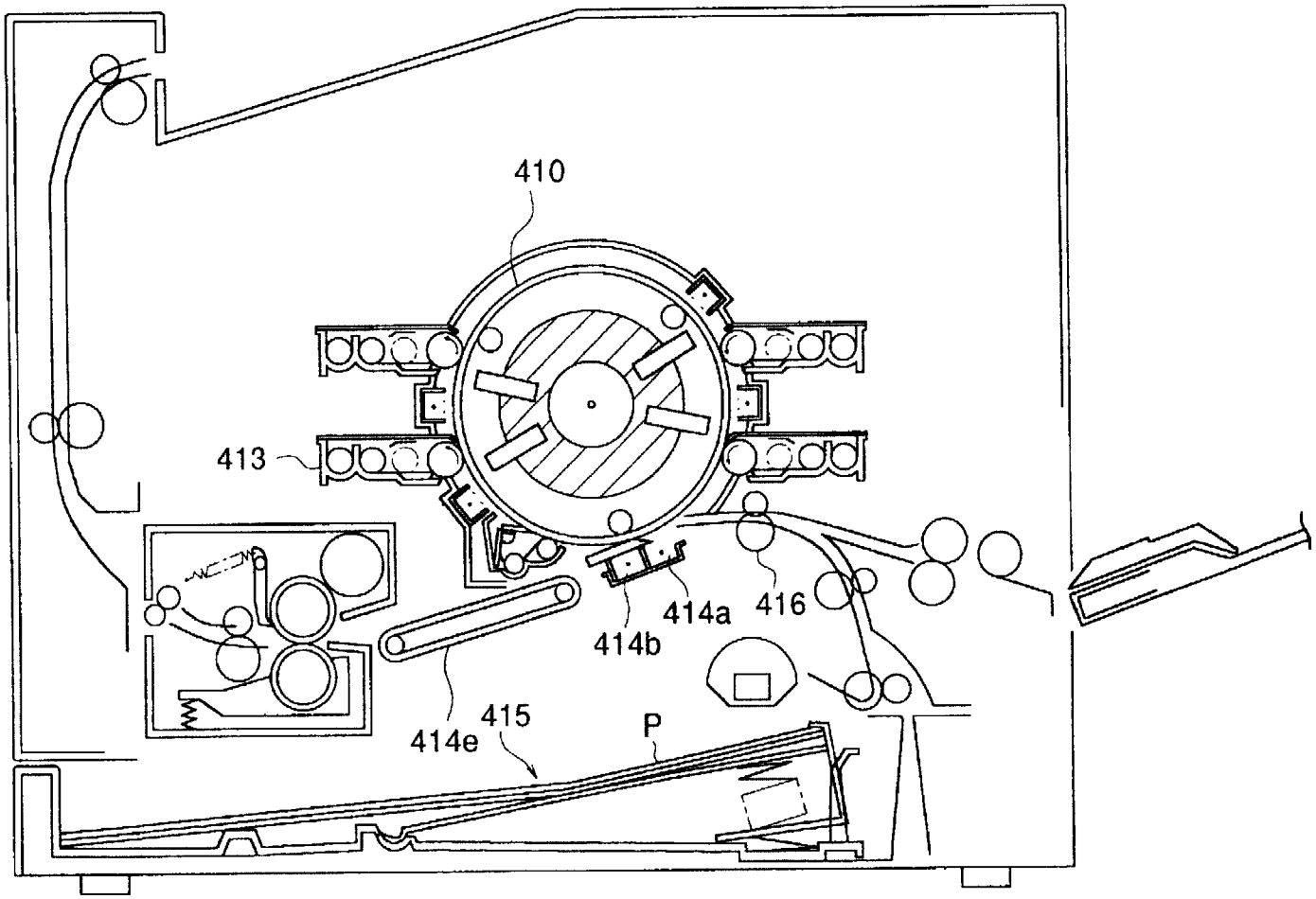
FIG. 6 is a drawing showing a color image forming apparatus of the prior application.

FIGS. 5(*a*) and 5(*b*) is drawings showing paper jamming clearance procedure. As shown in FIG. 5(*b*), when jamming occurred, paper feeding conveyance unit 250 which contains paper feeding cassette 15, upper and lower guide rollers **15*a* and 15*b* which constitute a horizontal paper feeding conveyance path and a paper ejecting path, registration roller 16, intermediate transfer roller 41, transfer roller 45, conveyance belt 114, fixing device 17, paper-ejecting rollers 18 and paper feeding and conveyance unit 250, which contains waste toner container 22, which is provided between the above-mentioned horizontal paper feeding conveyance and paper ejecting path and paper feeding cassette 15 is withdrawn from color image forming apparatus 100** so that the jammed recording paper is removed.

FIG. 5(*a*) shows the state in which paper feeding conveyance unit 250 is attached to color image forming apparatus 100.

Upper guide plate **15*a* and intermediate transfer roller 41 is opened by pivoting with fulcrum shaft 15*c* as a fulcrum so that paper jamming clearance is facilitated. In addition, lower guide plate 15*b* is opened pivoting with fulcrum shaft 15*d* as the fulcrum. Accordingly, waste toner container 22 is replaced. When paper feeding conveyance unit 250 is detached from or attached to color image forming apparatus 100, unillustrated jointing portion between toner conveyance pipe 19*d* and waste toner container 22** are canceled or combined.

According to the present invention, as results of controlling the transfer region and improving the paper feeding, conveyance and paper-ejection systems of the transfer region in the color image forming apparatus, due to well-balanced pushing pressure by plural developing devices located outside the image forming body on the tube-shaped image forming body which rotates which driving the image forming apparatus, the photoreceptor drum can stably rotate and no fluctuation occurs in the clearance between the tube-shaped image forming body which rotates during driving the image forming apparatus and each developing device, the light-exposure optical system and the charging device. Accordingly, an image forming apparatus wherein desirable images can be maintained could be provided and desirable color image by means of superposed toner image which necessitates uniform light exposure for each color could be formed.

Due to well-balanced pushing pressure by blades on the cleaning devices and the intermediate transfer roller in addition to well-balanced pushing pressure by plural developing devices located outside the image forming body, the photoreceptor drum can stably rotates and no fluctuation occurs in the gap between the tube-shaped image forming body which rotates during driving the image forming apparatus and each developing device, the light-exposure optical system and the charging device. Accordingly, an image forming apparatus wherein desirable images can be maintained could be provided and desirable color images by means of superposed toner image which necessitates uniform light exposure for each color could be formed.

In addition, due to controlling the transfer region and improving the paper feeding, conveyance and paper-ejection system of the recording medium, the intermediate transfer means, the paper feeding means and the fixing device became possible to be withdrawn integrally so that the color image forming apparatus wherein paper jamming clearance in the paper feeding and paper ejecting system of the recording medium is easy could be provided.

In addition, due to improving the transfer region of the color image forming apparatus, downsizing of the photoreceptor became possible, and specifically downsizing of the photoreceptor drum became possible.

Figure 7:
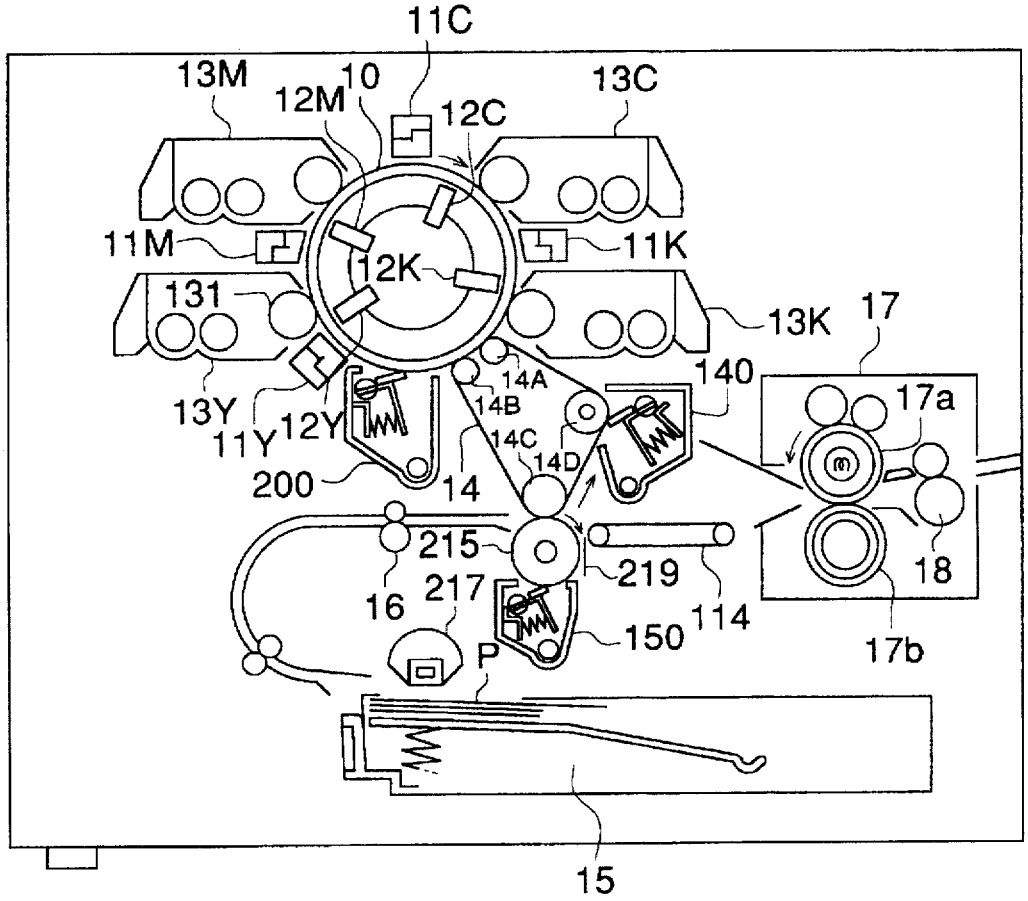
FIG. 7 is a cross-sectional diagram of a color image forming apparatus.
Figure 8:
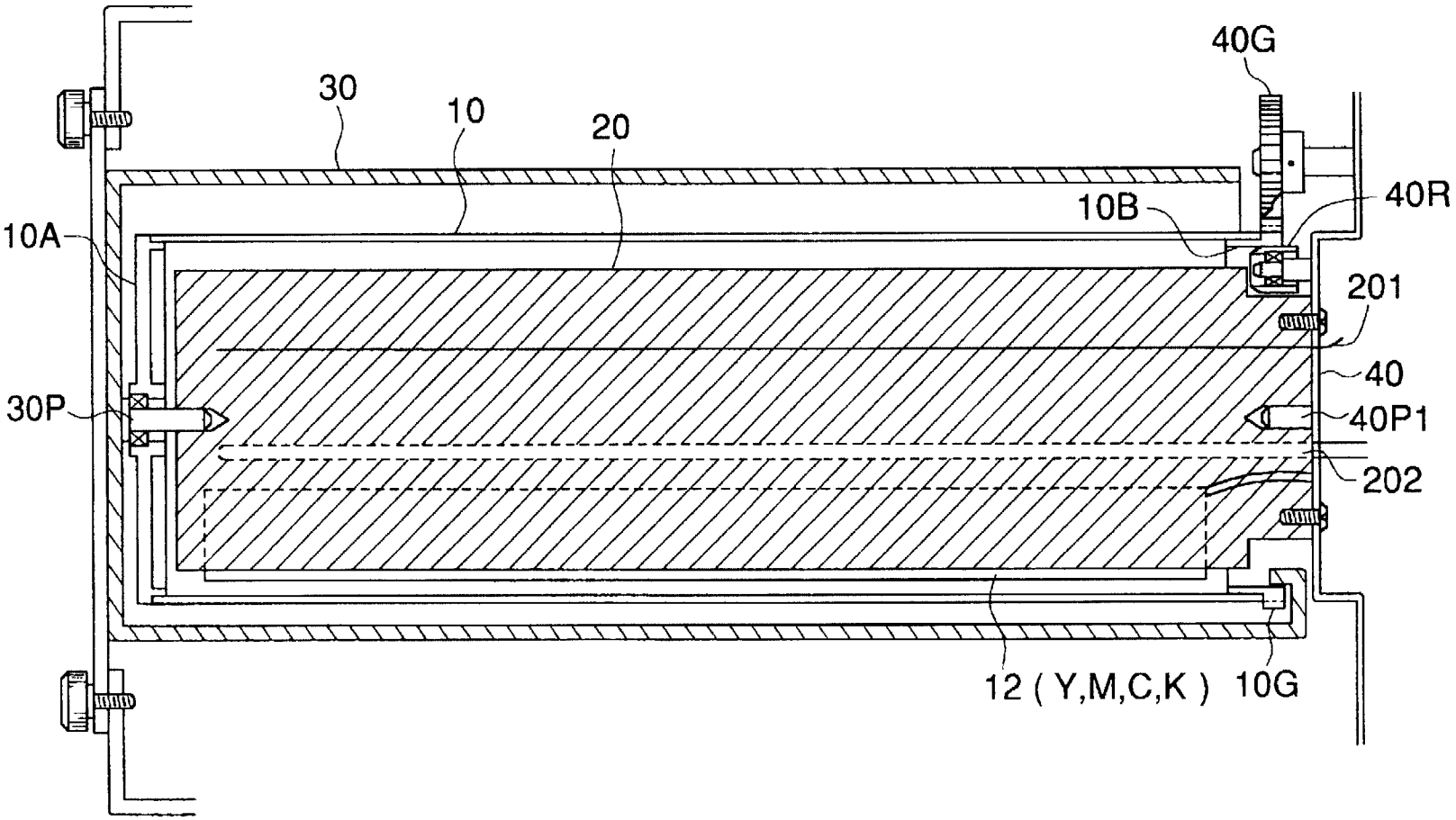
FIG. 8 is a cross-sectional diagram of a photoreceptor

Prior to the explanation of Examples 2 through 6 of the embodiments for attaining the second object, the constitution of a color image forming apparatus common to each Example will be explained referring to FIGS. 7 and 8.

Numeral 10 is a drum-shaped image former, i.e., a photoreceptor drum, wherein a transparent conductive layer and an organic photosensitive layer (OPC) are coated on the circumference of a tube-shaped substrate formed of a transparent member such as optical glass or transparent acrylic resin.

On the photoreceptor drum 10, flange 10A on one end is bearing-supported by guide pin 30P provided on cartridge 30, and flange 10B on the other end is put on with plural guide roller 40R provided on substrate 40 for the apparatus main body so that circumferential gear 10G is engaged with driving gear 40G. Due to power from driving gear 40G, the photoreceptor is rotated clockwise while the transparent conductive layer is electrically grounded.

Numerals 11Y, 11M, 11C and 11K show respectively scorotron chargers, and charge the above-mentioned organic photoreceptor layer on photoreceptor drum 10 by means of a grid kept at a prescribed potential using corona discharger using a discharging wire, providing uniform potential on photoreceptor 10.

Numerals 12Y, 12M, 12C and 12K show respectively a light-exposure optical system constituted of LED and a Selfoc lens which are arranged in an axis direction of photoreceptor 10, wherein image signals for each color, which are read by an image reading apparatus provided separately, are subsequently taken from memory and inputted to each of the light-exposure optical systems 12 (Y, M, C and K), as electrical signals.

Each of the light-exposure optical systems 12 (Y, M, C and K) are mounted on a tube supporting member 20 which is fixed on substrate 40 of the apparatus main body with guide pin 40P1 as a guide, and housed inside the substrate of the photoreceptor drum 10.

Numerals 13Y, 13M, 13C and 13K are developing devices which respectively house a yellow (Y), magenta (M), cyan (C) and K (black) developer. Each of them are equipped with developing sleeve 131 which rotates in the same direction, while keeping a prescribed clearance with the circumference of photoreceptor drum 10.

Each of the above-mentioned developing devices 13 (Y, M, C and K) reverse-develops static latent images, on photoreceptor drum 10, formed due to charging by means of the charger 11 (Y, M, C and K), and imagewise light-exposure by means of the above-mentioned light-exposure optical system 12 (Y, M, C and K) in a non-contact state while impressing of development bias voltage.

Next, the process of the color image forming apparatus in the present apparatus will now be explained.

From an original, images are read by an imaging device or edited by a computer in an image reading apparatus provided separately. Aforesaid images are temporarily memorized and housed in a memory as image signals for each color.

When image recording starts, due to the activation of the photoreceptor driving motor, the driving gear 40G rotates photoreceptor drum 10 clockwise. Concurrently with this, due to the charging effect of charger 11Y, provision of potential to photoreceptor drum 10 starts.

After provision of potential to photoreceptor drum 10, in the light-exposure optical systems 12Y, light-exposure by means of electrical signals corresponding to the first color signals, i.e., yellow (Y) image signals, starts. Due to the rotational scanning by the drum, latent images corresponding to the yellow (Y) images in the original images are formed on the surface of the drum.

The above-mentioned latent images are subjected to reversal development by developing device 13 (Y) under status that the developer on the developing sleeve is not contacted so that yellow (Y) toner images are formed corresponding to the rotation of photoreceptor drum 10.

Next, on photoreceptor drum 10, potential was provided on the yellow (Y) toner images due to charging effect by charger 11M. Light-exposure due to electrical signals corresponding to the second color signals, i.e., magenta (M) image signals in light-exposure optical system 12M was conducted. Due to non-contact reverse development by means of developing device 13M, magenta (M) toner images were subsequently superposed on the yellow (Y) toner images.

In a similar manner, cyan (C) toner images corresponding to the third color signals were subsequently superposed on the magenta (M) toner images by means of charger 11C, light-exposure optical system 12C and developing device 13C, and then, black (K) toner images corresponding to the fourth color signals were subsequently superposed on the cyan (C) toner images by means of charger 11K, light-exposure optical system 12K and developing device 13K. Thus, within one rotation of photoreceptor drum 10, color toner images are formed on the circumference thereof.

Light-exposure on the organic photosensitive layer on photoreceptor drum 10 by means of each of the light-exposure optical systems is conducted through the transparent substrate from inside the drum. Accordingly, light-exposure to images corresponding to the second, third and fourth color signals is conducted and not being influenced from toner images which have already been formed at all so that static latent images in the same manner as in the images corresponding to the first color signal can be formed. The photoreceptor drum 10 houses light-exposure optical system 12 (Y, M, C and K) so that the transfer region is improved. As a result, it is possible to employ a small-sized drum having an outer diameter of 60–200 mm so that the apparatus can be downsized. For stabilization of the temperature and prevention of temperature increase inside photoreceptor drum 10, due to heating by each light-exposure optical system 12 (Y, M, C and K), materials having good heat transmissivity are employed for the above-mentioned supporting member 20. When the temperature inside photoreceptor drum 10 is low, heater 201 is employed. When it is high, heat pipe 202 is used to radiate heat away. Accordingly, temperature can be regulated to the extent that it has no adverse effect. When developing by the use of each developing device, developing bias to which either a D.C. electric current or a D.C. electric current and an A.C. current are impressed on developing sleeve 131, and jumping development by a one-component developer or two-component developer housed in each developing device is conducted so that non-contact reverse developing is conducted on photoreceptor drum 10 wherein the transparent conductive layer is electrically grounded.

Thus, color toner images formed on the circumference of photoreceptor drum 10 are temporarily transferred to the circumference of intermediate transfer belt 14 which is an intermediate transfer member.

The intermediate transfer belt 14 is composed of urethane rubber having thickness of 100–500 μm and electric resistance of $10^8$–$10^{11}$ Ω cm, wherein a Teflon layer having the similar resistance value is provided on the surface layer for easy separation of the transfer medium. The intermediate transfer belt 14 is stretched over rollers 14A, 14B, 14C and 14D. By means of power transferred to roller 14D, the intermediate transfer belt 14 is circulated counter-clockwise synchronously with the circumferential speed of photoreceptor 10.

Intermediate transfer belt 14, which is the above-mentioned intermediate transfer material, is brought into contact with the circumference of photoreceptor drum 10 by means of a belt surface between roller 14A and roller 14B, and, on the other hand, the belt surface on the outer circumference of roller 14C is brought into contact with transfer roller 215, which is a transfer member. At each contact point, the transfer region of the toner images is formed.

The color toner images adhered to the circumference of photoreceptor drum 10 are, at the contact point with the intermediate transfer belt 14, subsequently transferred to the outer circumference of intermediate transfer belt 14 due to impressing of bias voltage having a reversed polarity of the toner on roller 14B. Namely, the color toner images on the drum are conveyed to the transfer region without scattering of the toner due to guiding of electrically grounded roller 14A, and then, transferred effectively on intermediate transfer belt 14 due to impressing 1 or 2 kv bias voltage onto roller 14B.

On the other hand, due to actuation of paper feeding roller 217 in paper feeding cassette 15, transfer paper P is conveyed out, and then, fed to timing roller 16. Synchronously with the conveyance of the color toner image on intermediate transfer belt 14, the transfer paper is fed to the transfer region on transfer roller 215.

Transfer roller 215 synchronously rotates clockwise with the circumferential speed of the intermediate transfer belt 14. The fed transfer paper P is brought into contact with the color toner images on intermediate transfer belt 14 at the transfer region formed by a nip portion between transfer belt 215 and the above-mentioned electrically grounded roller 14C, and then, transferred transfer paper P, due to impressing 1 or 2 kv bias voltage having a reversed polarity of the toner onto transfer roller 215. The above-mentioned intermediate transfer belt 14 and transfer roller 215 compose the transfer means.

Transfer paper P onto which the color toner images is discharged by means of discharging wires 219, conveyed to fixing device 17 through conveyance belt 114, sandwiched and conveyed between heater roller 17*a* and pressure roller 17*b* for heating, the toner on the paper is fused for fixing and then, is ejected out of the apparatus through paper ejecting rollers 18.

The photoreceptor 10, intermediate transfer belt 14 and transfer roller 215, are provided with cleaning devices 200, 140 and 150 respectively. Blades provided therein are constantly brought into contact with the photoreceptor 10, intermediate transfer belt 14 and transfer roller 215 so that remaining toner adhered is removed, to keep the circumference thereof constantly clean.

(EXAMPLE 2)

Figure 9:
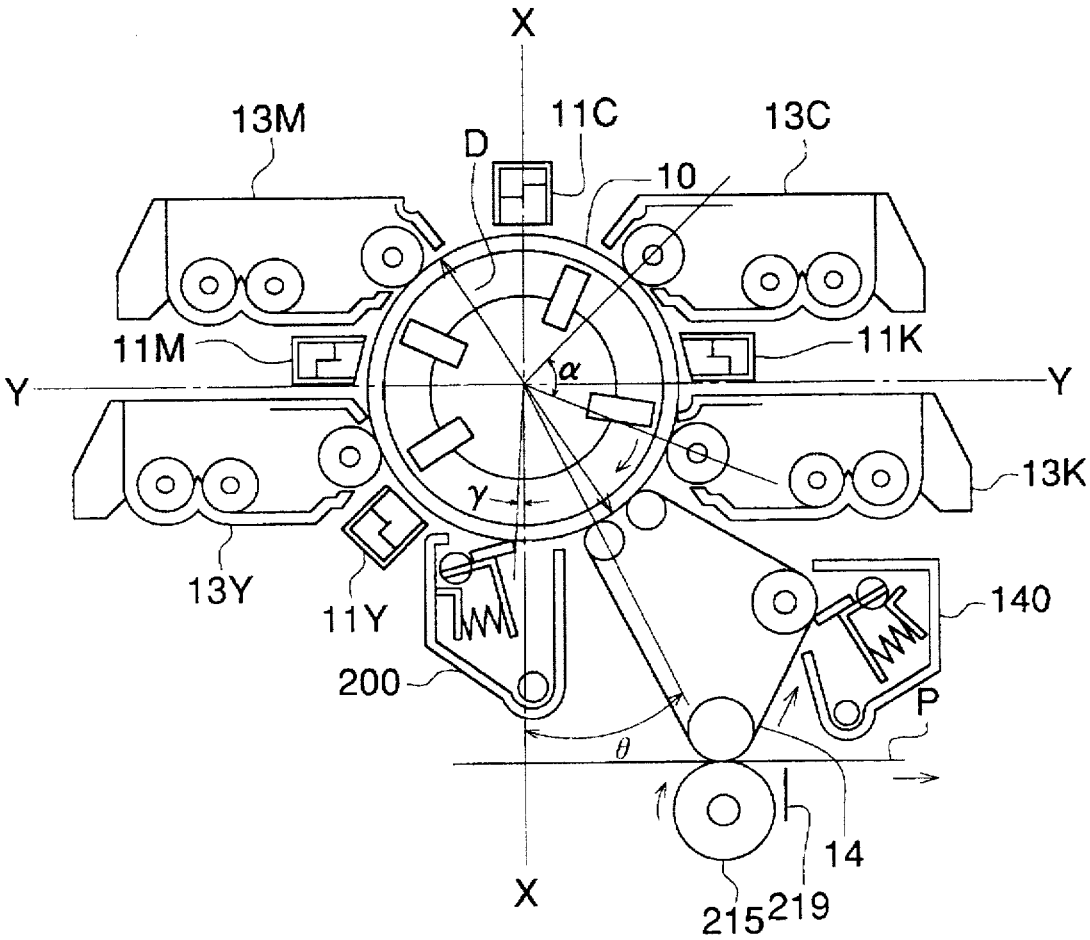
FIG. 9 is a location drawing showing layout of the image forming material.

Example 2 relating to the above-mentioned embodiment 1 for attaining the second object will now be explained referring to FIGS. 9, 10(*a*) and 10(*b*).

By the use of the intermediate transfer belt 14 for the transfer means of the toner images, the above-mentioned color image forming apparatus of the present invention realizes to shift the conveyance surface of transfer paper P to a position separated from the circumference of photoreceptor drum 10. Due to this, a new space is created on the circumference of the drum so that, as shown in FIG. 9, image forming equipment such as each of the above-mentioned developing device, chargers and cleaners are placed at well-balanced position without generating waste space.

At space created below the circumference of the drum created by shifting the conveyance path of transfer paper P, the intermediate transfer belt 14 and, concurrently with this, cleaning device for photoreceptor drum 10 are provided.

As a result, with regard to each of the above-mentioned developing devices 13 (Y, M, C and K), developing devices 13M and 13Y are positioned at the left and developing devices 13C and 13K are positioned at the right side of the vertical line XX. In addition, developing devices 13M and 13C are positioned above and developing devices 13Y and 13K are positioned below the horizontal line YY with enough room. Due to the above-mentioned structure, weight is well-balanced and developing devices 13 (Y, M, C and K) and other equipment are easily attachable and detachable.

Incidentally, the angles made by developing device 13Y, developing device 13M and the center of photoreceptor drum 10, and C developing device 13C, developing device 13K and the center of photoreceptor drum 10 are preferably 45° or more, and more preferably 60° or more, and also preferably 90° or less. As the angles become less than 60°, rotation of the image forming apparatus tends to be unstable. As the angles becomes larger than 90°, pressure by the developing device becomes unstable. In addition, setting of the cleaning device and the intermediate transfer belt becomes difficult.

By arranging the above-mentioned cleaning device 200 in such a manner that the angle γ made by the edge of the above-mentioned cleaning device 200 and vertical line XX is within ±10°, the above-mentioned intermediate transfer belt 14 can be positioned within a range shown as θ in FIG. 3, which is 5° through 45° made by vertical line XX and upstream side of the less than half rotation of the drum. Due to the above-mentioned structure, each developing device 13 (Y, M, C and K) can be placed almost symmetrically to the vertical line XX and the horizontal line YY so that balance and operability are further improved.

In addition, each of the developing devices 13 (Y, M, C and K), integrally with each charger 11 (Y, M, C and K), and the intermediate transfer belt 14, integral with its cleaning device 140 and the cleaning devices 200, are detached and attached from the front of FIG. 3 of the apparatus main body due to the sliding of the guide member.

Figure 10:
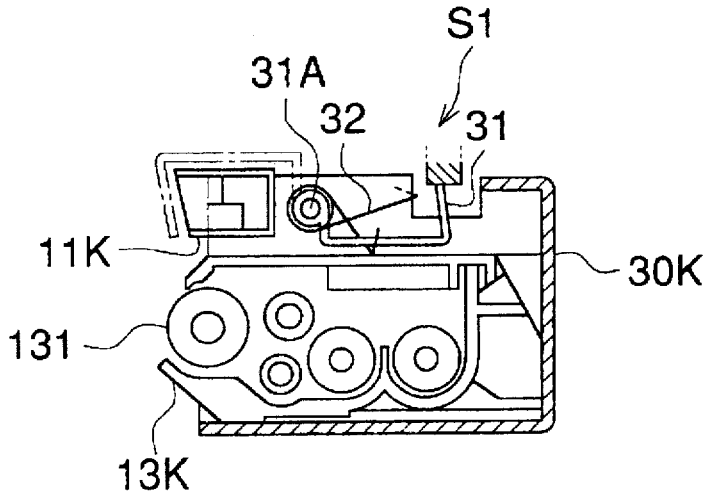
FIGS. 10(*a*) and 10(*b*) are block diagrams of each unit of developing devices and the intermediate transfer belt.
Figure 10:
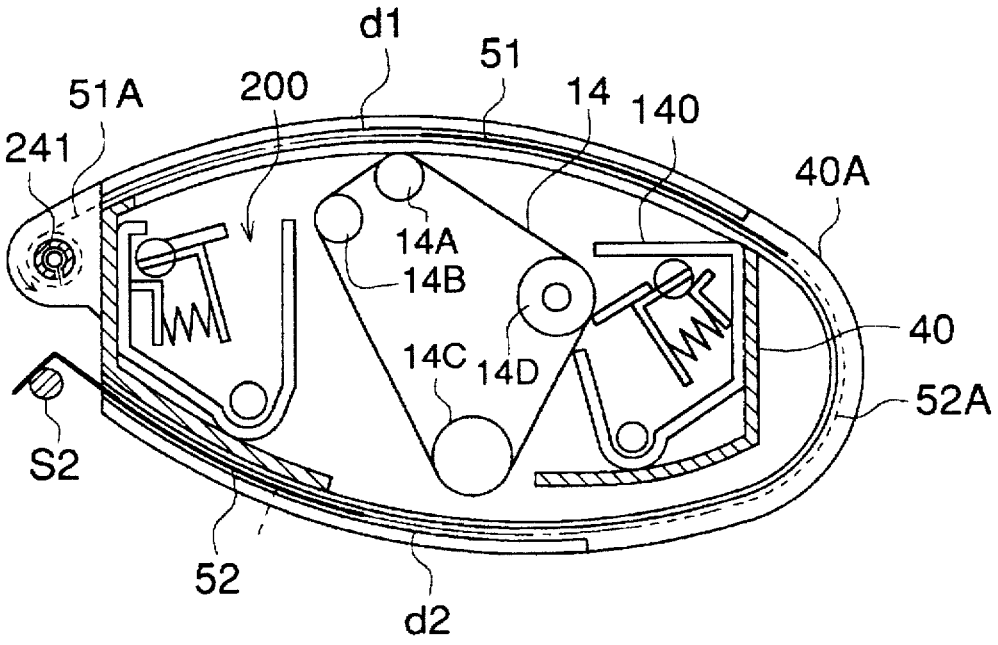

FIG. 10(*a*) shows developing device unit 30K, as an example, which integrally houses developing device 13K and charger 11K which are fixed on both side walls. Inside unit 30K, shielding member 31 is bridged on the side wall and supported by shaft 31A. Shielding member 31 is constantly forced in such a manner that it is rotated counter-clockwise by means of torsion spring 32.

When attaching developing device unit 30K to the charged main body, if the above-mentioned shielding member 31 is rotated clockwise to be inserted, while pressing it, into a position illustrated by a continuous line, the edge portion of shielding member 31 is secured by holding member S1 provided on the apparatus main body side so that the shielding member 31 is maintained almost at a position illustrated by the continuous line, keeping the opening port of charger 11K open. On the contrary, the shielding member 31 is withdrawn from the apparatus main body, it is released by means of holding member S1. Therefore, shielding member 31 rotates counter-clockwise so that it is shifted to the position illustrated by the dashed line. Thus, the opening port of charger 11K is automatically closed, preventing adherence or intrusion of dust and other foreign substances.

In the same manner as in the above, each of the other developing devices 13 (Y, M and C) and each of the other chargers 11 (Y, M and C) can also be provided with shielding member 31 after assembly. In addition, if space allows, the end portion of shielding member 31 can be extended and opening port of developing devices 13 (Y, M, C and K).

FIG. 10(*b*) shows an intermediate transfer belt unit 40 integrally housing an intermediate transfer belt 14, its cleaning device 140 and cleaning device 200 for photoreceptor drum 10. The above-mentioned unit 40, between integral front and rear side walls 40A, supports or fixes each of the rollers which support intermediate transfer belt 14, cleaning devices 140 and 200. In addition, inside side wall 40A, upper groove d1 and lower groove d2 are provided. In d1 and d2, flexible plate-shaped elastic shielding plates 51 and 52 are inserted slidable and supported by the grooves.

A side of one end of the above-mentioned shielding plate 51 is connected to winding shaft 241 through cord 51A (shown by a broken line). The side of the above-mentioned shielding plate 52 is connected to the side on the other end of the above-mentioned shielding plate 51.

The above-mentioned winding shaft 241 is biased by a coil spring provided therein in such a manner that it constantly rotates several time counter-clockwise.

When the intermediate transfer belt unit 40 is attached to the apparatus main body, if the shielding plate 52 is slid to the left direction and is inserted to a position shown as a continuous line, the rising portion of the shielding plate 52 is coupled by a coupling member of the apparatus main body so that shielding plate 52 is maintained together with the shielding plate 51 at a position illustrated by the continuous line. Thus, cleaning device 200 and the upper portion of intermediate transfer belt 14 are released so that they face the circumference of photoreceptor drum 10 on the apparatus main body side, and concurrently with this, the lower portion of intermediate transfer belt 14 is also released so that it is faced with the circumference of transfer roller 215. Therefore, two facing regions form transfer region of the toner images respectively. When shielding plates 51 and 51 are drawn out of the apparatus main body, securing due to coupling member S2 is canceled so that shielding plates 51 and 52 shift to the position illustrated by a dashed line respectively through cords 51A and 52A due to rotation of the winding shaft 241. They automatically close the upper portion of cleaning device 200 and the upper portion and the lower portions of intermediate transfer belt 14 simultaneously so that adherence or intrusion of dust and other foreign substances is prevented.

Both of the above-mentioned developing device unit 30K and intermediate transfer belt unit 40 are detached and attached through a guide rail which can move them forward and backward. However, when the system is structured is that intermediate transfer belt 14 is detached and attached as a unit, it is also structured that photoreceptor drum 10 can be removed upward.

Figure 17:
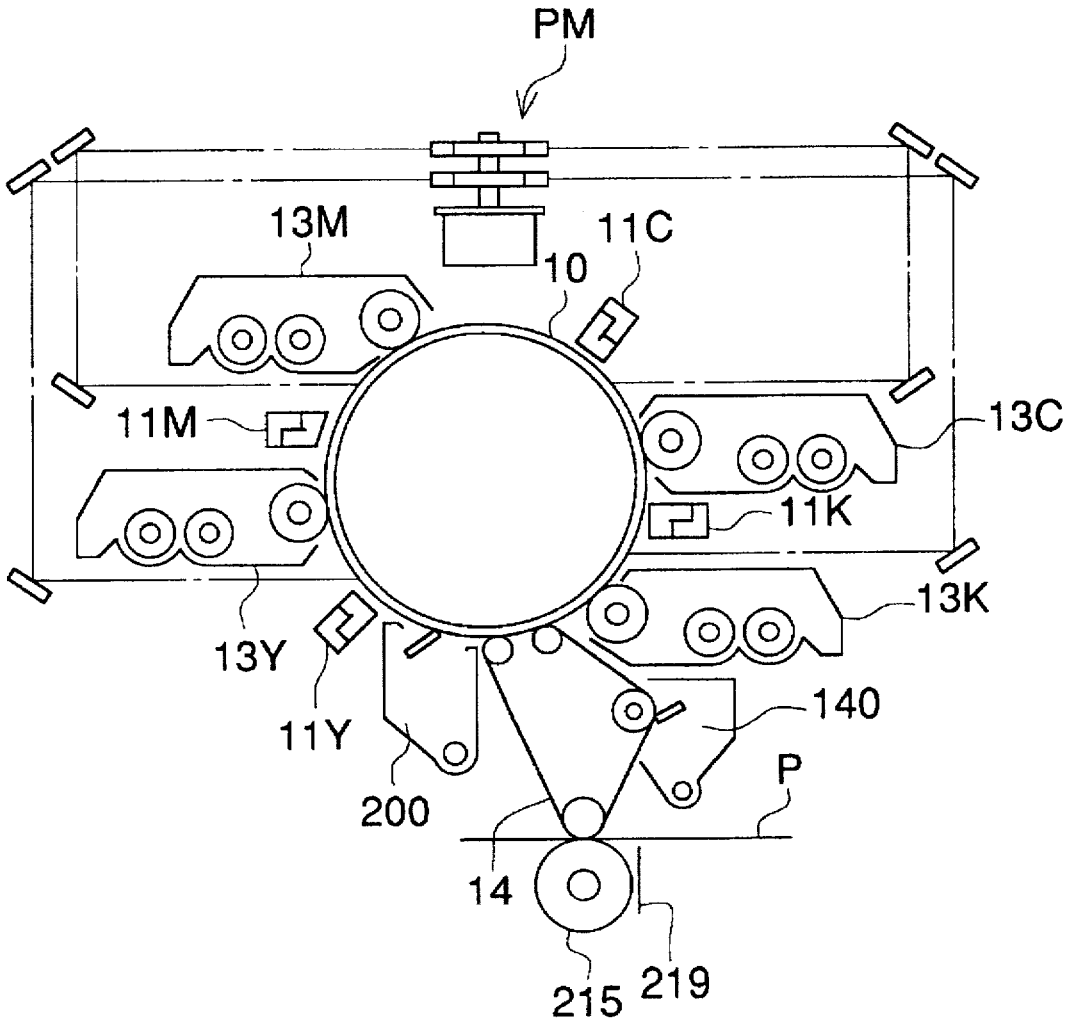
FIG. 17 is a schematic drawing of a color image forming apparatus conducting imagewise exposure by means of a laser optical system.
Figure 18:
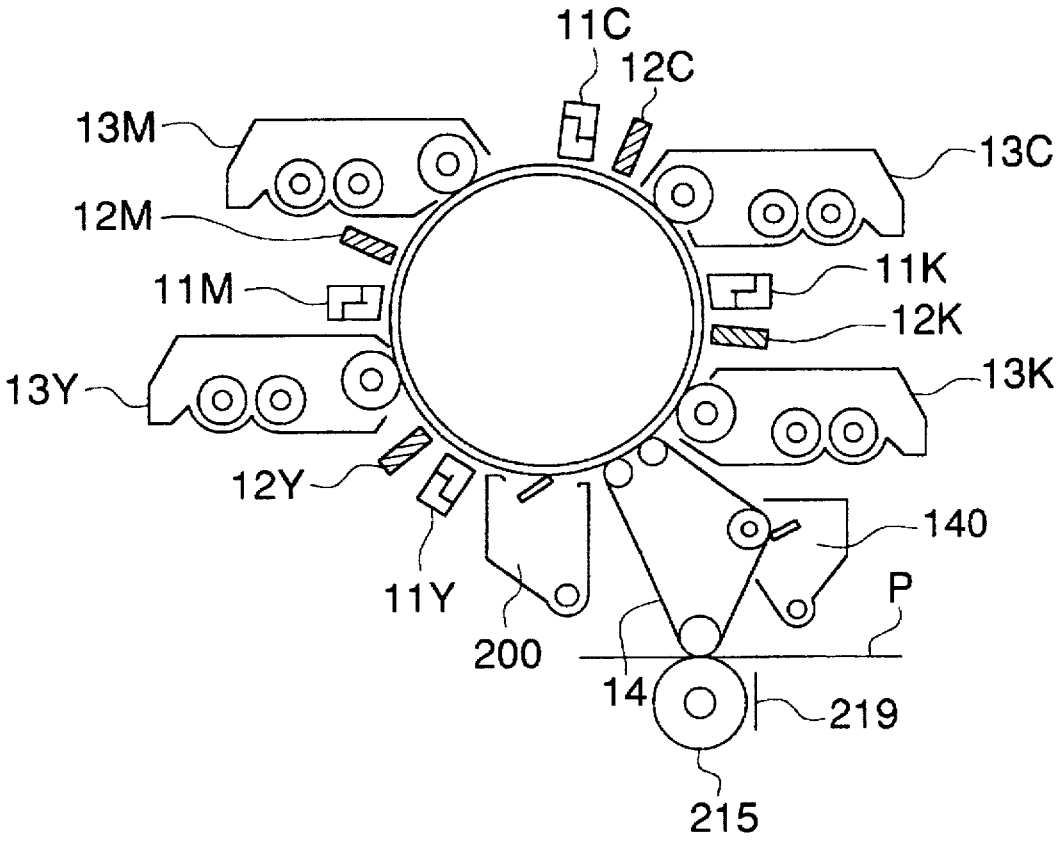
FIG. 18 is a schematic drawing of a color image forming apparatus conducting imagewise exposure by means of a line-head optical system.

In aforesaid Example 2 and Examples 4, 5 and 6 mentioned below, a color image forming apparatus was and will be explained in which an imagewise exposure means is housed inside a transparent photoreceptor drum and images are exposed to light from inside the drum to the outer-circumference of the photoreceptor. However, the present invention is applicable to a color image forming apparatus, as shown in FIG. 17, wherein a laser optical type optical path of four optical sources not illustrated and rotation of polygonal mirror PM is divided into a left side and a right side and images exposed to light are scanned or a color image forming apparatus, as shown in FIG. 18, wherein images are exposed to light from outside of photoreceptor drum 10 due to light exposure scanning by means of a line head optical system using an LED and a Selfoc lens. The same effects as detailed in Example 2, 4, 5 and 6 can be obtained.

(EXAMPLE 3)

Figure 11:
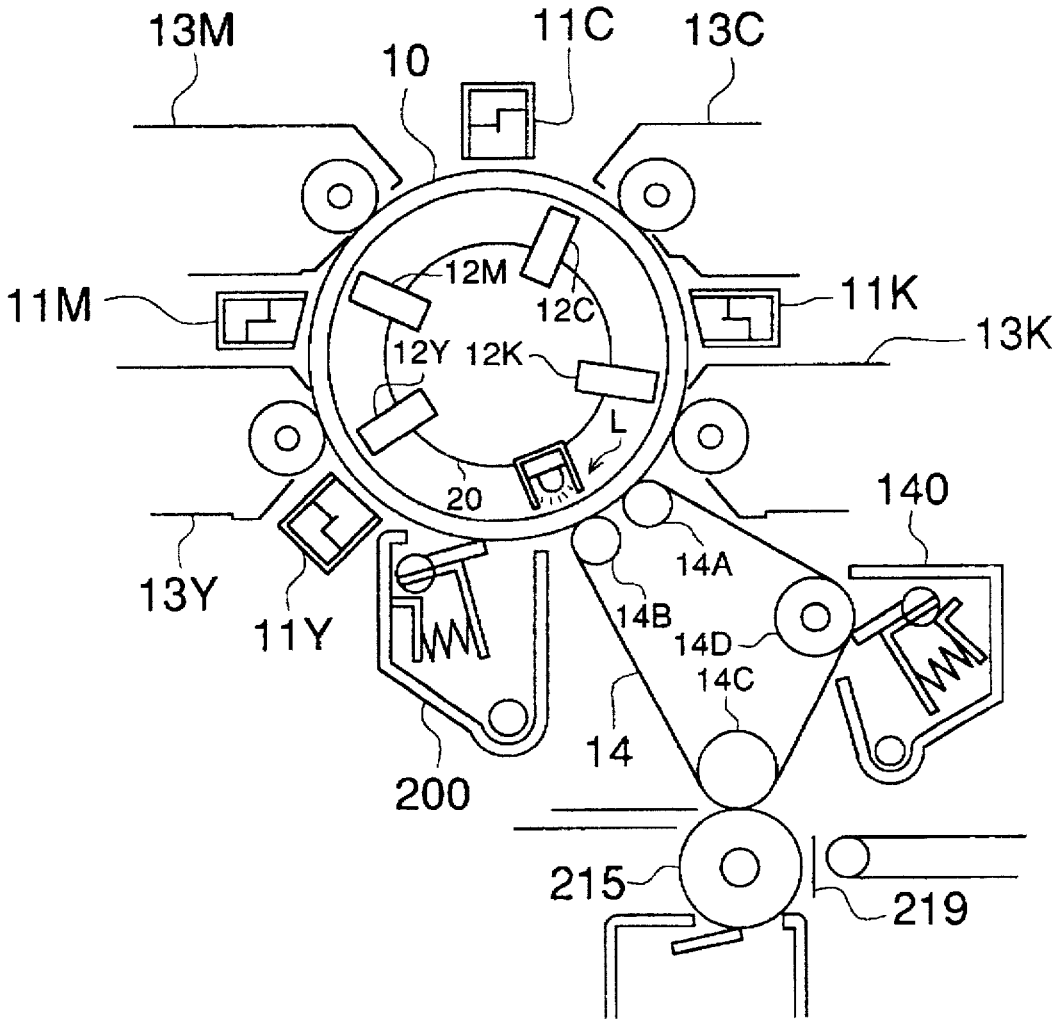
FIG. 11 is a location drawing of a lamp for concurrently transferring and exposing.

Example 3 of the above-mentioned second embodiment of the present invention will now be explained, referring to FIG. 11.

In the color image forming apparatus of the present invention, photoreceptor drum 10 is equipped with discharging lamp L as a light-exposure means on an internal supporting member 20 which faces the above-mentioned intermediate transfer belt 14.

The above-mentioned discharging lamp L comprises an LED array arranged in an axial direction of the drum and a reflection member for collecting light. Discharging lamp L is positioned facing roller 14B of intermediate transfer belt 14. It is lit from the internal surface of photoreceptor drum 10 synchronously with the transfer of color toner images to the intermediate transfer belt 14, i.e., impressing bias voltage to the above-mentioned roller 14B.

Light emitted from discharging lamp L penetrates the transparent substrate of photoreceptor drum 10 to reach the photoreceptor at the outermost layer of the photoreceptor. Due to this, the photoreceptor under charging status is discharged so that transfer efficiency of the color toner images on intermediate transfer drum 14 is improved.

As described above, placing discharging lamp L inside photoreceptor drum 10 enables the photoreceptor to be discharged due to exposure from the rear side of the transfer portion, concurrently with this, transferring to the intermediate transfer belt 14. Therefore, toner scattering of the color toner images on the photoreceptor which tends to follow discharging can be prevented. The color toner images are transferred to intermediate transfer belt 14 with high transfer efficiency while keeping the image quality when the images are formed.

In such occasions, exposed light may be reflected by intermediate transfer belt 14 which is an intermediate transfer member, conduct light discharge in the photoreceptor drum and damage latent images. In order to prevent the occurrence of the above-mentioned harmful effects of reflected light due to the above-mentioned exposed light, it is preferable to use black or lusterless material, for intermediate transfer belt 14, which can absorbs the exposed light.

Incidentally, when intermediate transfer belt 14 is transparent, it is preferable to use a back up roller as a light absorption member.

(EXAMPLE 4)

Example 4 of the above-mentioned third embodiment of the present invention will now be explained referring to FIGS. 12 and 14, and also FIGS. 13 and 15 which respectively shows plain location of FIGS. 12 and 14.

Figure 12:
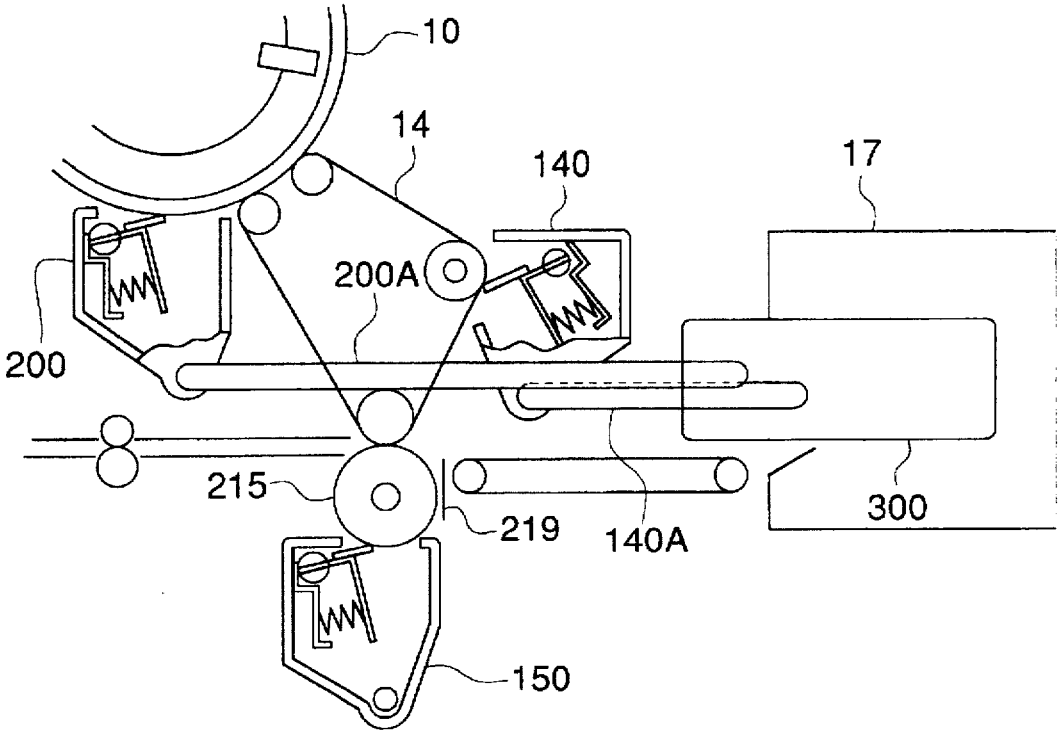
FIG. 12 is a front view of a waste toner collection path (No. 1).

In the present invention, the above-mentioned cleaning device 200 located in the vicinity of photoreceptor drum 10 and the cleaning device 140 located for the intermediate transfer belt respectively transport waste toner, through toner conveyance tube 200A and 140A respectively positioned almost horizontally on front side of the apparatus main body as shown in FIG. 12, waste toner storing container 300, where waste toner is stored, which is located on front side of fixing device 17.

Figure 13:
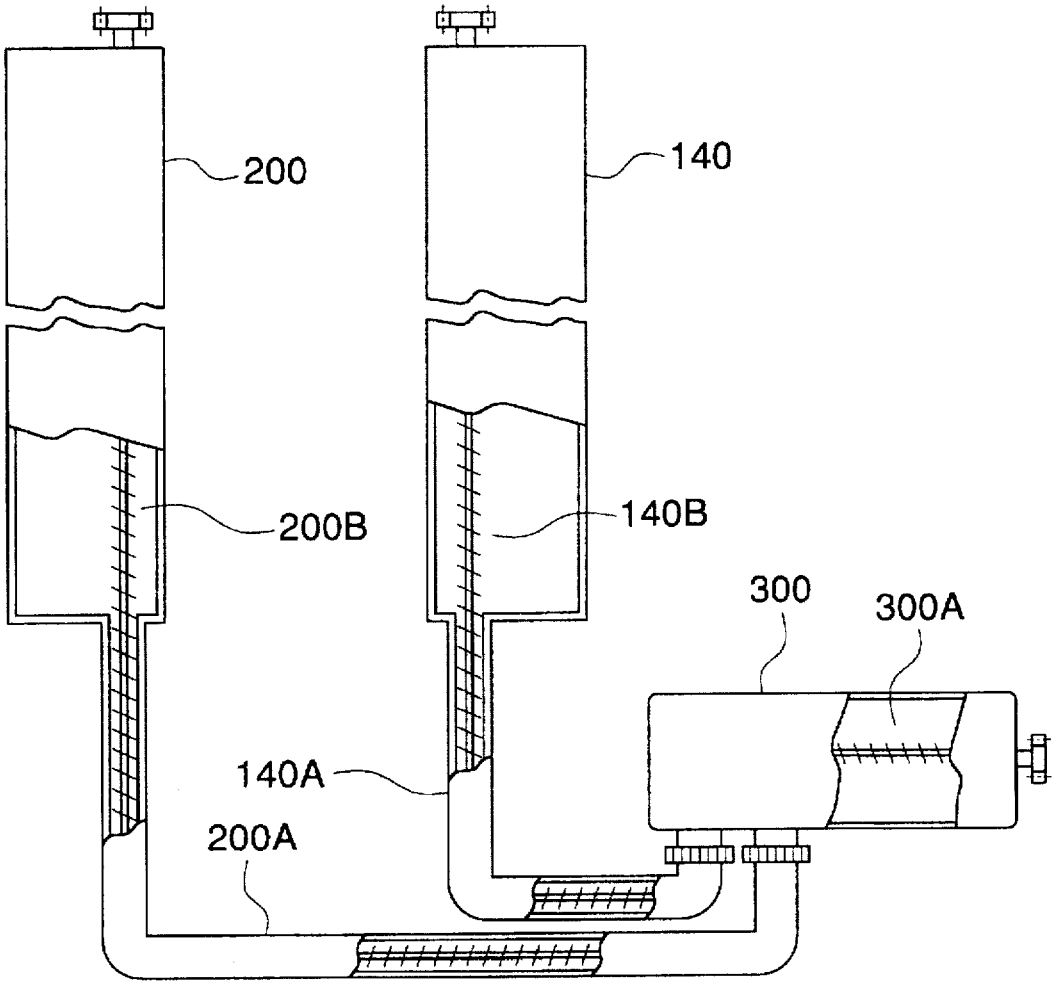
FIG. 13 is a plain view of a waste toner collection path (No. 1).

As shown in FIG. 13, the extended portions of flexible conveyance archimedian screws 200B and 140B respectively built-into each cleaning device is inserted into each toner conveyance tube so that residual toner or adhered toner collected from photoreceptor drum 10 and intermediate transfer belt 14 is all collected in the waste toner storing container 300 through each toner conveyance tube, due to the rotation of each of the above-mentioned conveyance screw. In addition, it is also structured that waste toner collected and stored inside the waste toner storing container 300 is uniformly mixed in aforesaid toner container due to toner conveyance screw 300A integrally housed in aforesaid container so that storing efficiency of the container is enhanced.

Since each of the above-mentioned toner conveyance tubes and waste toner storing container 300 are located on front side of the apparatus main body, aforesaid waste toner storing container 300 can be removed from the apparatus due to separating the joint portion so that it is so extremely convenient as to be able to collect waste toner and dispose of it collectively.

In addition to the above-mentioned cleaning devices 200 and 140, waste toner collected from cleaning device 150 which was located on transfer roller 215 may also be collected to the identical waste toner storing container by the use of the identical toner conveyance tube, to be disposed of from these.

Figure 14:
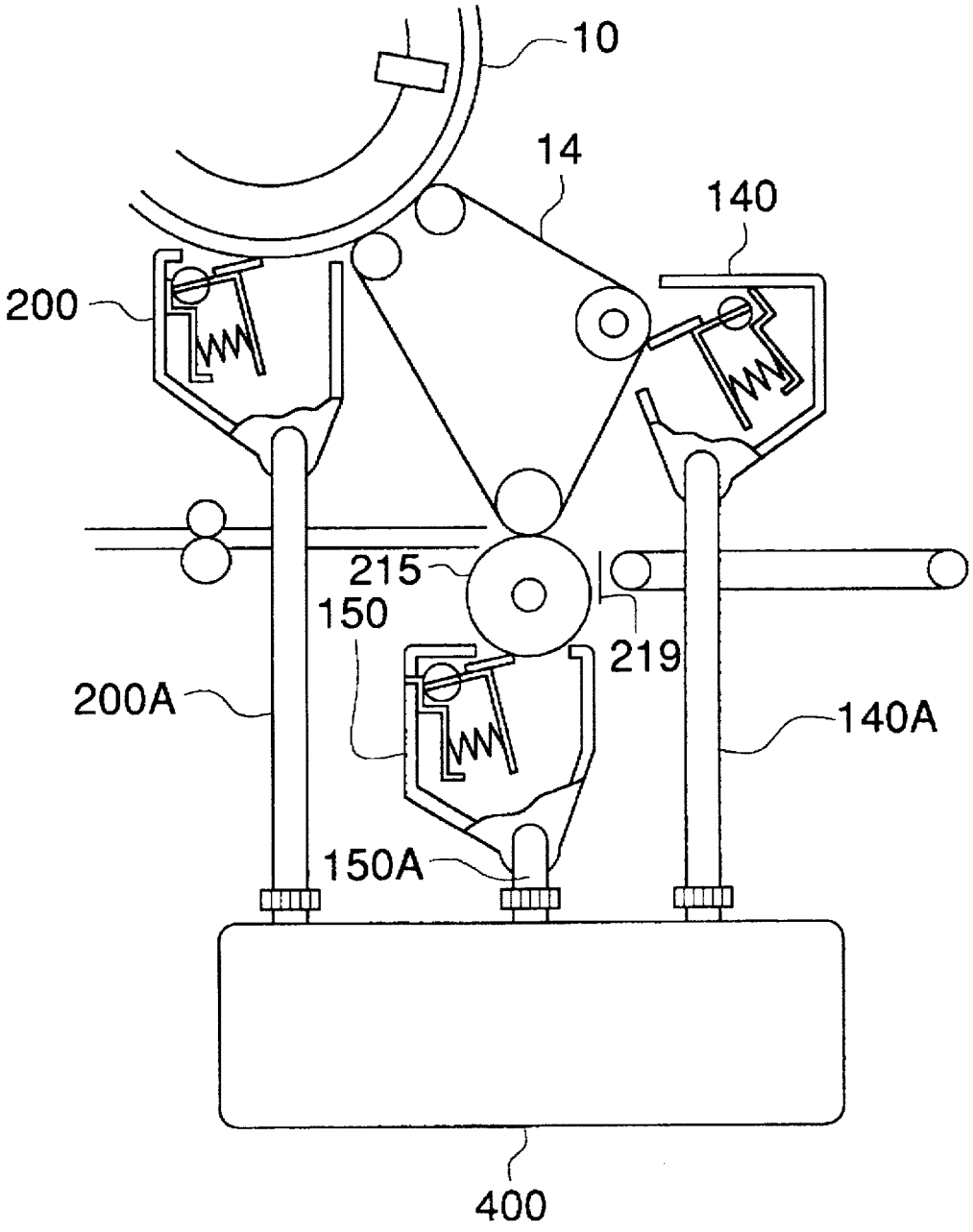
FIG. 14 is a front view of a waste toner collection path (No. 2).

As shown in FIG. 14, cleaning devices 200, 140 and 150 are connected to waste toner storing container 400 at the bottom through toner conveyance tubes 200A, 140A and 150A which are provided almost vertically on front side of the apparatus main body.

The extended portion of conveyance screws 200B, 140B and 150B respectively housed in each cleaning device are inserted into each of the above-mentioned toner conveyance tubes 200A, 140A and 140A. Remaining toner or adhered toner, collected from photoreceptor drum 10, intermediate transfer belt 14 and transfer roller 215 after the transfer of color toner images, moves inside each of the toner conveyance tubes due to the rotation of each of the above-mentioned conveyance screws and drops so that the remaining toner or adhered toner is collected by the above-mentioned waste toner storing container 400. In addition, waste toner stored inside the toner after being collected to aforesaid waste toner storing container is uniformly mixed in aforesaid toner due to toner conveyance screw 400A integrally housed in aforesaid container so that storing efficiency of the container is enhanced.

Namely, due to the use of the intermediate transfer belt, number of point where waste toner can adhered or be generated increases. However, since waste toner from plural cleaning devices which are provided at places where waste toner adheres or occurs is collected in a common waste toner storing container, disposal of waste toner becomes easier and fear of toner leaking becomes minimized.

(EXAMPLE 5)

Figure 16:
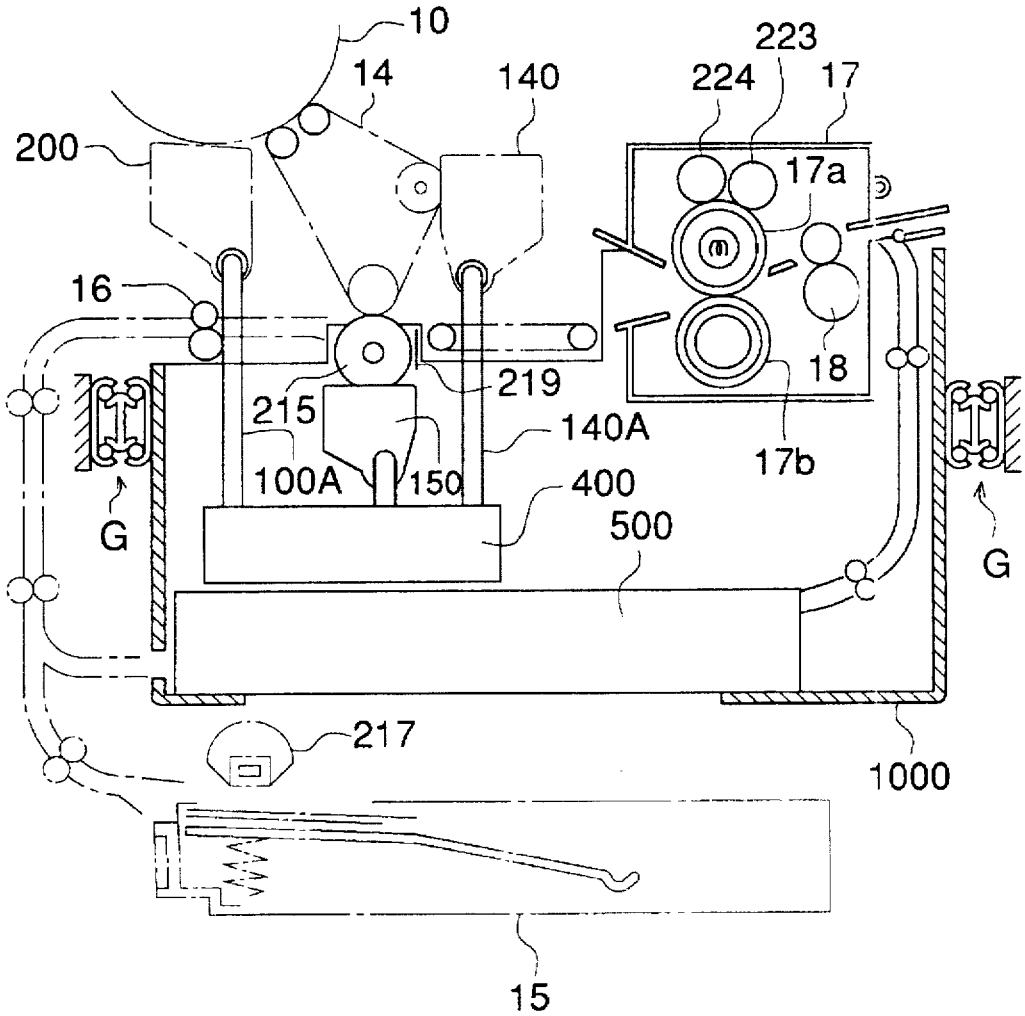
FIG. 16 is a schematic diagram of a cartridge housing the transfer roller and a fixing device.

An invention of the above-mentioned fourth embodiment of the present invention will now be explained referring to FIG. 16.

In the present invention, the above-mentioned transfer roller 215 and fixing device 17 are housed in cartridge 1000 together with cleaning device 150 provided for transfer roller 215 and waste toner storing container 400 to which waster toner is collected from each of the above-mentioned cleaning devices 200 and 140 and integrally detached from and attached to the apparatus main body. Incidentally, when the apparatus is equipped with a function to record images on front and rear sides of recording paper P, duplex unit 500 which reverses the front and rear side of recording paper is also housed in the above-mentioned cartridge 1000.

The above-mentioned cartridge 1000 is supported inside of the apparatus through paired guide members G, provided at the left side and the right side and are capable of being extending to 2 steps, which is referred to as Arcuride rail, and is fixed at a prescribed position. When Arcuride rail can be slid to the front of the drawing after opening the front side of the apparatus main body and canceling the catching, Arcuride rail is easily shifted to a withdrawing position outside the apparatus main body due to its attachment position.

Incidentally, prior to sliding of cartridge 1000 to the front, the joints of toner conveyance tubes 200A and 140A with cleaning devices 200 and 140 are respectively separated. In addition, due to the start of sliding of cartridge 1000 to the withdrawing position, each connection for supplying power and electrical power from the apparatus main body and fixing device 17 is automatically shut off.

Due to sliding of cartridge 1000 to the withdrawing position, each conveyance path of recording paper P formed inside the apparatus main body is widened so that jam-clearing operations are facilitated and, concurrently with this, replacement of transfer roller 215 and fixing device 17 and also replacement of cleaning roller 223, oil pad 224 or oil tank (not shown) due to releasing of the top of the fixing device 17 becomes possible so that extremely detailed maintenance becomes possible.

(EXAMPLE 6)

Figure 19:
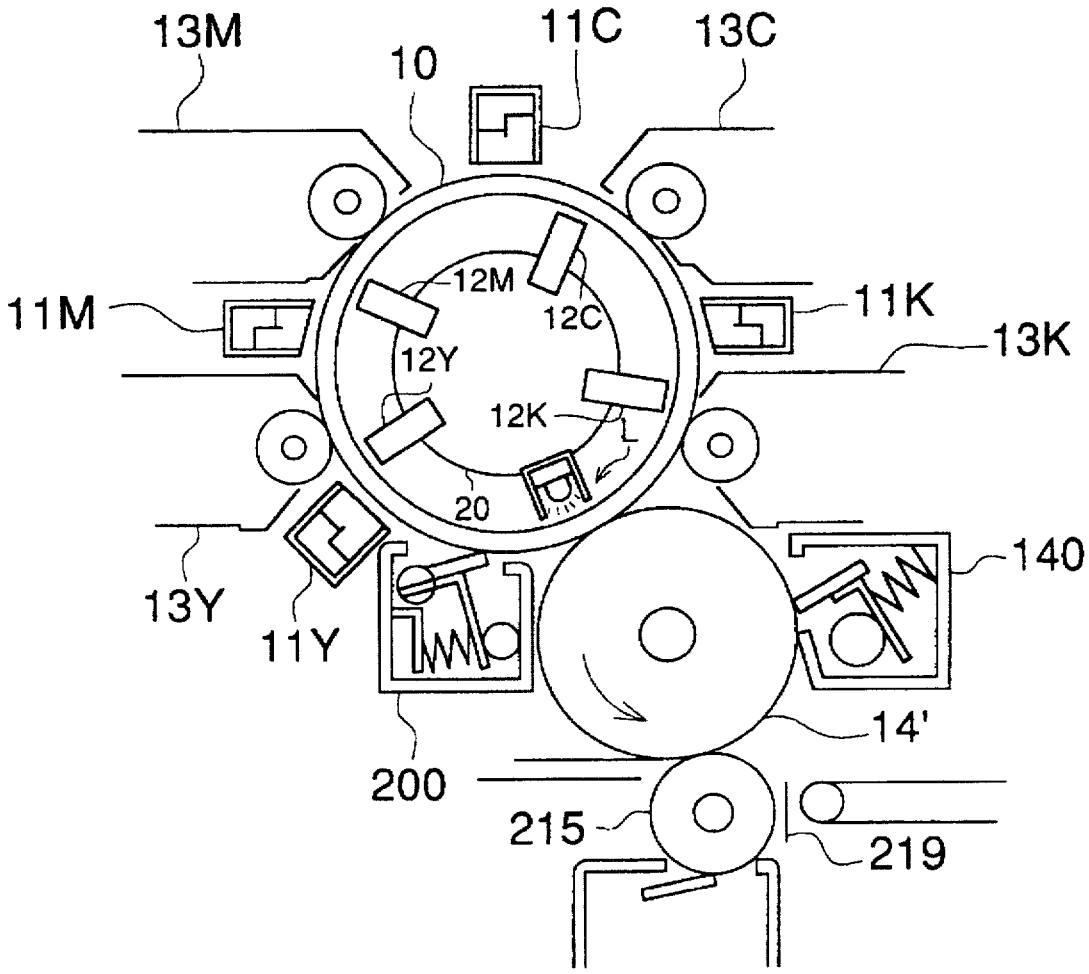
FIG. 19 is a schematic diagram of a color image forming apparatus which uses an intermediate transfer roller.

The present example shown in FIG. 19 employs intermediate transfer roller 14'. Since FIG. 19 is the same as FIG. 11 except for intermediate transfer roller 14', the same numerals are provided and further explanation is omitted. Intermediate transfer roller 14' is a roller which contacts the photoreceptor drum and rotates synchronously at the circumferential speed of photoreceptor drum 10 in the transfer region. On a metal substrate, an urethane rubber layer having thickness of 20–1000 μm and electrical resistance of $10^8$–$10^{11}\Omega\cdot$cm as an elastic layer and additionally similar Teflon layer for separation were coated. In this occasion too, the present invention is applicable in the same manner as in Examples 2–5 explained above.

Owing to the present invention, due to the use of the intermediate transfer body during the transfer process of the images, the layout of the apparatus is well-balanced and results in ease of operability. In addition, reduction of transfer efficiency following the use of aforesaid intermediate transfer body, a waste toner disposing problem due to the increase of cleaning points and other maintenance difficulty such as paper jamming clearance are, in all, solved. As a result, a color image forming apparatus wherein its image quality is high, maintenance control is easy and thereby it is extremely useful.

What is claimed is:

1. A color image forming apparatus comprising:

(a) a drum type image forming body;

(b) charging means for charging the image forming body;

(c) a plurality of exposure means each for imagewise exposing the charged image forming body to form a latent image;

(d) a plurality of developing means each provided around the image forming body for developing the latent image to form a different colored toner image, wherein operations by the charging means, the exposure means and the developing means are repeated to superimpose the different colored toner images on the image forming body; and (e) transfer means including an intermediate transferring member and a transfer member in contact with the intermediate transferring member, for transferring the superimposed colored toner images onto a recording material.

2. The color image forming apparatus of claim 1, wherein two developing means are disposed at left and right positions, respectively, with respect to a vertical line passing a center of the image forming body, and another two developing means are disposed at upper and lower positions, respectively, with respect to a horizontal line passing the center of the image forming body.

3. The color image forming apparatus of claim 1, wherein the intermediate transferring member is disposed on one side of the lower position with respect to the horizontal line and on one side with respect to the vertical line.

4. The color image forming apparatus of claim 1 further comprising cleaning means for cleaning residual toner on the image forming body, wherein the cleaning means is disposed at the lower position with respect to the horizontal line and adjacent to the vertical line.

5. The color image forming apparatus of claim 1, wherein the intermediate transferring member is disposed on an upstream side by 5° to 45° of a rotation direction of the image forming body.

6. The color image forming apparatus of claim 1, wherein the cleaning means is disposed within ±10° with respect to the vertical line.

7. The color image forming apparatus of claim 1, wherein a replaceable unit including the intermediate transferring member and the cleaning means is attachable to and detachable from the main body of the apparatus.

8. The color image forming apparatus of claim 1 further comprising second cleaning means for cleaning the transfer member, wherein a replaceable unit including the transfer member and the second cleaning means is attachable to and detachable from the main body of the apparatus.

9. The color image forming apparatus of claim 1, wherein a replaceable unit including the charging means and the developing means is attachable to and detachable from the main body of the apparatus.

10. The color image forming apparatus of claim 1 further comprising an exposure device provided inside the image forming body and at a position opposite to the intermediate transferring member, for exposing the image forming body to neutralize at the same time that the intermediate transferring member transfers.

11. The color image forming apparatus of claim 10, wherein the intermediate transferring member absorbs an exposed light emitted from the exposure device.

12. The color image forming apparatus of claim 1 further comprising a waste toner storing container for storing waste toner collected from the image forming body and the intermediate transferring member.

13. The color image forming apparatus of claim 12, wherein the waste toner storing container further stores waste toner collected from the transfer member.

14. The color image forming apparatus of claim 1 further comprising a fixing device for fixing the transferred toner images on the recording material, wherein a unit integrated with the transfer member and the fixing device can be pulled out from the main body of the apparatus.

15. The color image forming apparatus of claim 14, wherein when the unit is pulled out from the main body, the transfer member and a waste toner storing container for storing waste toner collected from the transfer member, the image forming body and the intermediate transferring member can be replaced.

16. The color image forming apparatus of claim 14, wherein when the unit is pulled out from the main body, the fixing device or accessories thereof can be replaced.

17. The color image forming apparatus of claim 1 further comprising four paired of pressing members for pressing four developing means respectively in a horizontal direction against the image forming body.

18. The color image forming apparatus of claim 1, wherein four exposure means are provided inside the image forming body.

19. The color image forming apparatus of claim 1, wherein the four developing means are disposed at positions where the four developing means are located symmetrically with respect to the horizontal line and the vertical line.

20. The color image forming apparatus of claim 1, wherein an angle between a line connecting the center of the image forming body and a center of a developing sleeve of each of the two developing means provided on the upper and lower sides is not less than 45° and not more than 90°.

21. The color image forming apparatus of claim 1, wherein an angle between the vertical line passing the center of the image forming body, and a contacting position of the image forming body with the intermediate transferring member is not less than 5° and not more than 45°.

* * * * *